US011312138B2

(12) United States Patent
Kanegae et al.

(10) Patent No.: US 11,312,138 B2
(45) Date of Patent: Apr. 26, 2022

(54) LIQUID EJECTING UNIT, LIQUID EJECTING HEAD, SUPPORT BODY FOR LIQUID EJECTING HEAD

(71) Applicant: SEIKO EPSON CORPORATION, Tokyo (JP)

(72) Inventors: Takahiro Kanegae, Shiojiri (JP); Hiroyuki Hagiwara, Matsumoto (JP); Katsuhiro Okubo, Azumino (JP); Masahiko Sato, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 35 days.

(21) Appl. No.: 16/783,384

(22) Filed: Feb. 6, 2020

(65) Prior Publication Data

US 2020/0171824 A1 Jun. 4, 2020

Related U.S. Application Data

(63) Continuation of application No. 15/416,737, filed on Jan. 26, 2017, now Pat. No. 10,576,743.

(30) Foreign Application Priority Data

Feb. 2, 2016 (JP) ..... 2016-017935

(51) Int. Cl.
*B41J 2/14* (2006.01)
*B41J 2/15* (2006.01)

(52) U.S. Cl.
CPC ..... *B41J 2/1433* (2013.01); *B41J 2/14024* (2013.01); *B41J 2/15* (2013.01); *B41J 2002/14266* (2013.01); *B41J 2202/19* (2013.01); *B41J 2202/20* (2013.01)

(58) Field of Classification Search
CPC ..... B41J 2/1433; B41J 2/15; B41J 2/14024; B41J 2202/20; B41J 2202/19; B41J 2002/14266
See application file for complete search history.

(56) References Cited

U.S. PATENT DOCUMENTS 6,350,013 B1 2/2002 Scheffelin
6,428,141 B1 8/2002 McElfresh et al.
(Continued)

FOREIGN PATENT DOCUMENTS

EP 2913188 9/2015
GB 2449939 12/2008
(Continued)

OTHER PUBLICATIONS

European Search Report for U.S. Appl. No. 17/154,362, dated Aug. 8, 2017.
(Continued)

*Primary Examiner* — Yaovi M Ameh
(74) *Attorney, Agent, or Firm* — Workman Nydegger

(57) ABSTRACT

There is provided a liquid ejecting unit that ejects liquid from a plurality of nozzles, in which the planar shape of the ejecting face on which the nozzles are formed is a shape in which a first portion that passes through the center line parallel to the long side of the rectangle of the minimum area including the ejecting face and a second portion that does not pass through the center line are arranged in the direction of the long side.

8 Claims, 17 Drawing Sheets

(56) References Cited

U.S. PATENT DOCUMENTS

| | | | | |
|---|---|---|---|---|
| 6,467,874 | B1 * | 10/2002 | Williams | B41J 2/515 347/42 |
| 6,505,926 | B1 * | 1/2003 | Trafton | B41J 2/17513 347/86 |
| 2003/0081058 | A1 | 5/2003 | McElfresh et al. | |
| 2005/0116995 | A1 | 6/2005 | Tanikawa et al. | |
| 2005/0206678 | A1 | 9/2005 | Nishino | |
| 2010/0026759 | A1 | 2/2010 | Kobayashi et al. | |
| 2012/0113189 | A1 | 5/2012 | Kobayashi | |
| 2013/0050315 | A1 | 2/2013 | Kusakari | |
| 2013/0187976 | A1 | 7/2013 | Kobayashi | |
| 2014/0002547 | A1 * | 1/2014 | Owaki | B41J 2/17513 347/50 |
| 2015/0077473 | A1 | 3/2015 | Wanibe et al. | |

FOREIGN PATENT DOCUMENTS

| | | | |
|---|---|---|---|
| JP | 2005-138529 | A | 6/2005 |
| JP | 2010-179499 | A | 8/2010 |
| JP | 2015-058620 | A | 3/2015 |

OTHER PUBLICATIONS

European Search Report for U.S. Appl. No. 17/154,362, dated Nov. 14, 2017.

* cited by examiner

<CLOSED STATE>

<OPENED STATE>

LIQUID EJECTING UNIT, LIQUID EJECTING HEAD, SUPPORT BODY FOR LIQUID EJECTING HEAD

CROSS-REFERENCE TO RELATED APPLICATIONS

This application is a Continuation of U.S. patent application Ser. No. 15/416,737, filed Jan. 26, 2017, which claims priority to Japanese Patent Application No. 2016-017935, filed Feb. 2, 2016, which applications are hereby incorporated by reference in their entirety.

BACKGROUND

1. Technical Field

The present invention relates to a technique for ejecting liquid such as ink or like.

2. Related Art

In the related art, a liquid ejecting head that ejects liquid such as ink or the like from a plurality of nozzles formed on the ejecting face is proposed. For example, in JP-A-2010-179499, a configuration in which a plurality of liquid ejecting heads are fixed to a base plate so as to expose the ejecting face from an opening portion is disclosed.

However, in the technique disclosed in JP-A-2010-179499, since the plurality of liquid ejecting heads are disposed on the base plate in parallel, there is a problem that a reduction in the size of the whole device is limited.

SUMMARY

An advantage of some aspects of the invention is to reduce the size of the liquid ejecting head including a plurality of liquid ejecting units.

Aspect 1

According to a preferred aspect (Aspect 1) of the invention, there is provided a liquid ejecting unit that ejects liquid from a plurality of nozzles, in which the planar shape of the ejecting face on which the nozzles are formed is a shape in which a first portion that passes through the center line parallel to the long side of the rectangle of the minimum area including the ejecting face and a second portion that does not pass through the center line are arranged in the direction of the long side. According to the Aspect 1, the planar shape of the ejecting face is a shape in which the first portion that passes through the center line and the second portion that does not pass through the center line are arranged in the direction of the long side, and thus it is possible to arrange the plurality of liquid ejecting units in a linear shape along the center line. Therefore, there is an advantage in that the size in the width direction of the liquid ejecting units can be reduced.

Aspect 2 and Aspect 3

In a preferred example (Aspect 2) of the Aspect 1, the planar shape of the ejecting face may be a shape in which a third portion that does not pass through the center line is arranged on the side that is opposite to the second portion so as to interpose the first portion. In a preferred example (Aspect 3) of the Aspect 2, the second portion may be positioned on the opposite side of the third portion so as to interpose the center line.

Aspect 4

In the liquid ejecting unit according to a preferred example (Aspect 4) of the Aspect 2 or the Aspect 3, a first protruding portion that protrudes from the edge side of the first portion at the second portion side may be included. According to the Aspect 4, the first protruding portion protrudes from the edge side of the first portion on the second portion side, and thus it is possible to suppress the inclination of the liquid ejecting unit.

Aspect 5

In the liquid ejecting unit according to a preferred example (Aspect 5) of the Aspect 4, a second protruding portion that protrudes from the edge side of the third portion on the opposite side of the first portion may be included, and a notch portion that has a shape corresponding to the first protruding portion may be formed in the second protruding portion. According to the Aspect 5, the second protruding portion that protrudes from the edge side of the third portion on the opposite side of the first portion is provided, and thus it is possible to effectively suppress the inclination of the liquid ejecting unit. In addition, the notch portion that has a shape corresponding to the first protruding portion is formed in the second protruding portion, and thus, when a plurality of liquid ejecting units are arranged, it is possible to reduce the intervals between the liquid ejecting units.

Aspect 6

In a preferred example (Aspect 6) of any one of the Aspect 1 to the Aspect 5, a plurality of positioning portions for positioning to the support body that supports the liquid ejecting unit may be positioned on a straight line parallel to the center line. According to the Aspect 6, the positioning portions are positioned on a straight line parallel to the center line, and thus there is an advantage in that it is possible to suppress the inclination of the liquid ejecting unit, and that the liquid ejecting unit can be positioned on the support body with high accuracy.

Aspect 7

In a preferred example (Aspect 7) of any one of the Aspect 2 to the Aspect 6, the end portion of the second portion on the opposite side of the first portion and the end portion of the third portion on the opposite side of the first portion may be fixed to the support body that supports the liquid ejecting unit. According to the Aspect 7, the liquid ejecting unit at the both end portions of the ejecting face is fixed to the support body, and thus it is possible to effectively suppress the inclination of the liquid ejecting unit.

Aspect 8

In a preferred example (Aspect 8) of the Aspect 7, a plurality of opening portions that expose the ejecting face may be formed on the support body along a first direction. According to the Aspect 8, it is possible to fix the plurality of liquid ejecting units along the first direction.

Aspect 9

According to another preferred aspect (Aspect 9) of the invention, there is provided a liquid ejecting head, including: a first liquid ejecting unit and a second liquid ejecting unit each in which a plurality of nozzles for ejecting liquid are formed on the ejecting face; and a first support body that supports the first liquid ejecting unit and the second liquid ejecting unit, in which a first opening portion that exposes the ejecting face of the first liquid ejecting unit and a second opening portion that exposes the ejecting face of the second liquid ejecting unit are formed on the first support body along a first direction, and in which a beam-shaped portion between the first opening portion and the second opening portion includes a first support portion to which the first liquid ejecting unit is fixed and a second support portion to which the second liquid ejecting unit is fixed. According to the Aspect 9, the first support portion and the second support portion are formed on the beam-shaped portion between the first opening portion that exposes the ejecting face of the first liquid ejecting unit and the second opening portion that exposes the ejecting face of the second liquid ejecting unit, and thus there is an advantage in that the size of the first support body can be reduced.

Aspect 10

In a preferred example (Aspect 10) of the Aspect 9, the beam-shaped portion may include an intermediate portion that couples the first support portion and second support portion. According to the Aspect 10, the beam-shaped portion is formed in a shape in which the first support portion, the second support portion, and the intermediate portion are coupled to each other, and thus it is possible to increase the mechanical strength of the support body compared to a configuration in which the first support portion and the second support portion are separated from each other.

Aspect 11

According to still another preferred aspect (Aspect 11) of the invention, there is provided a support body for a liquid ejecting head that supports a first liquid ejecting unit and a second liquid ejecting unit each in which a plurality of nozzles for ejecting liquid are formed on the ejecting face, in which a first opening portion that exposes the ejecting face of the first liquid ejecting unit and a second opening portion that exposes the ejecting face of the second liquid ejecting unit are formed along a first direction, and in which a beam-shaped portion between the first opening portion and the second opening portion includes a first support portion to which the first liquid ejecting unit is fixed, and a second support portion to which the second liquid ejecting unit is fixed. According to the Aspect 11, the first support portion and the second support portion are formed on the beam-shaped portion between the first opening portion that exposes the ejecting face of the first liquid ejecting unit and the second opening portion that exposes the ejecting face of the second liquid ejecting unit, and thus there is an advantage in that the size of the support body for a liquid ejecting head can be reduced.

Aspect 12

In a preferred example (Aspect 12) of the Aspect 11, the beam-shaped portion may include an intermediate portion that couples the first support portion and second support portion. According to the Aspect 12, the beam-shaped portion is formed in a shape in which the first support portion, the second support portion, and the intermediate portion are coupled to each other, and thus it is possible to increase the mechanical strength of the support body compared to a configuration in which the first support portion and the second support portion are separated from each other.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
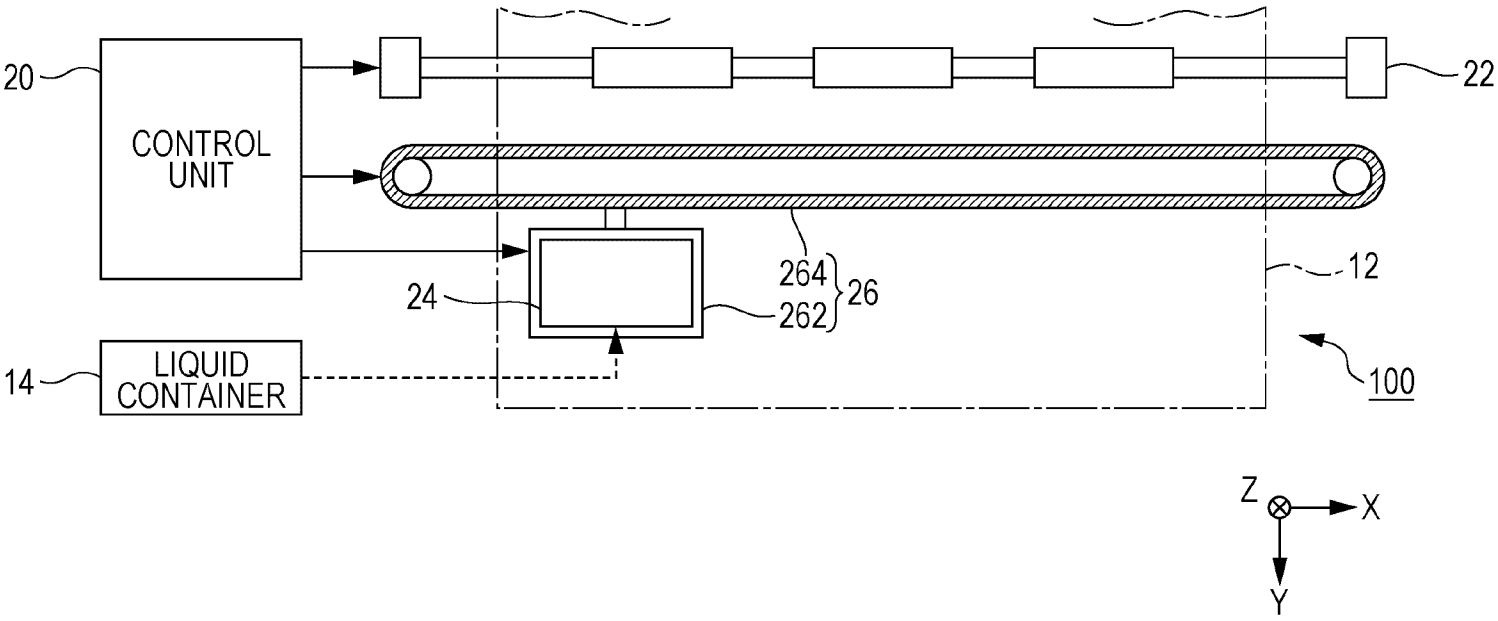
FIG. 1 is a configuration diagram of a liquid ejecting apparatus according to a first embodiment of the invention.

FIG. 1 is a configuration diagram of a liquid ejecting apparatus 100 according to a first embodiment of the invention. The liquid ejecting apparatus 100 according to the first embodiment is an ink jet type printing apparatus that ejects ink as an example of liquid onto a medium 12. The medium 12 is typically printing paper, but any printing object such as a resin film and a fabric may be used as the medium 12. A liquid container 14 that stores ink is fixed to the liquid ejecting apparatus 100. For example, a cartridge that can be attached and detached to and from the liquid ejecting apparatus 100, a bag-shaped ink pack that is formed by a flexible film, or an ink tank that can supplement ink is used as the liquid container 14. A plurality of types of ink with different colors are stored in the liquid container 14.

As illustrated in FIG. 1, the liquid ejecting apparatus 100 includes a control unit 20, a transport mechanism 22, and a liquid ejecting head 24. The control unit 20 is configured to include, for example, a control device such as a central processing unit (CPU), a field programmable gate array (FPGA), or the like and a memory device such as a semiconductor memory (not illustrated), and overall controls each element of the liquid ejecting apparatus 100 by executing a program stored in the memory device by the control device. The transport mechanism 22 transports the medium 12 to a Y-direction under the control of the control unit 20.

The liquid ejecting apparatus 100 according to the first embodiment includes a movement mechanism 26. The movement mechanism 26 is a mechanism that reciprocates the liquid ejecting head 24 to an X-direction under the control by the control unit 20. The X-direction in which the liquid ejecting head 24 is reciprocated is a direction that intersects (typically is orthogonal to) the Y-direction in which the medium 12 is transported. The movement mechanism 26 according to the first embodiment includes a transport body 262 and a transport belt 264. The transport body 262 is a substantially box-shaped structure (carriage) that supports the liquid ejecting head 24, and fixed to the transport belt 264. The transport belt 264 is an endless belt that is placed along the X-direction. The transport belt 264 is rotated under the control of the control unit 20, and thus the liquid ejecting head 24 is reciprocated along the X-direction together with the transport body 262. The liquid container 14 may be mounted to the transport body 262 together with the liquid ejecting head 24.

The liquid ejecting head 24 ejects the ink supplied from the liquid container 14 onto the medium 12 under the control of the control unit 20. The liquid ejecting head 24 ejects the ink onto the medium 12 during a period for which the transport of the medium 12 by the transport mechanism 22 and the transport of the liquid ejecting head 24 by the movement mechanism 26 are executed, and thus a desired image is formed on the medium 12. In the following description, a direction perpendicular to an X-Y plane is referred to as a Z-direction. The ink ejected from the liquid ejecting head 24 proceeds to the positive side of the Z-direction and is landed on the surface of the medium 12.

Figure 2:
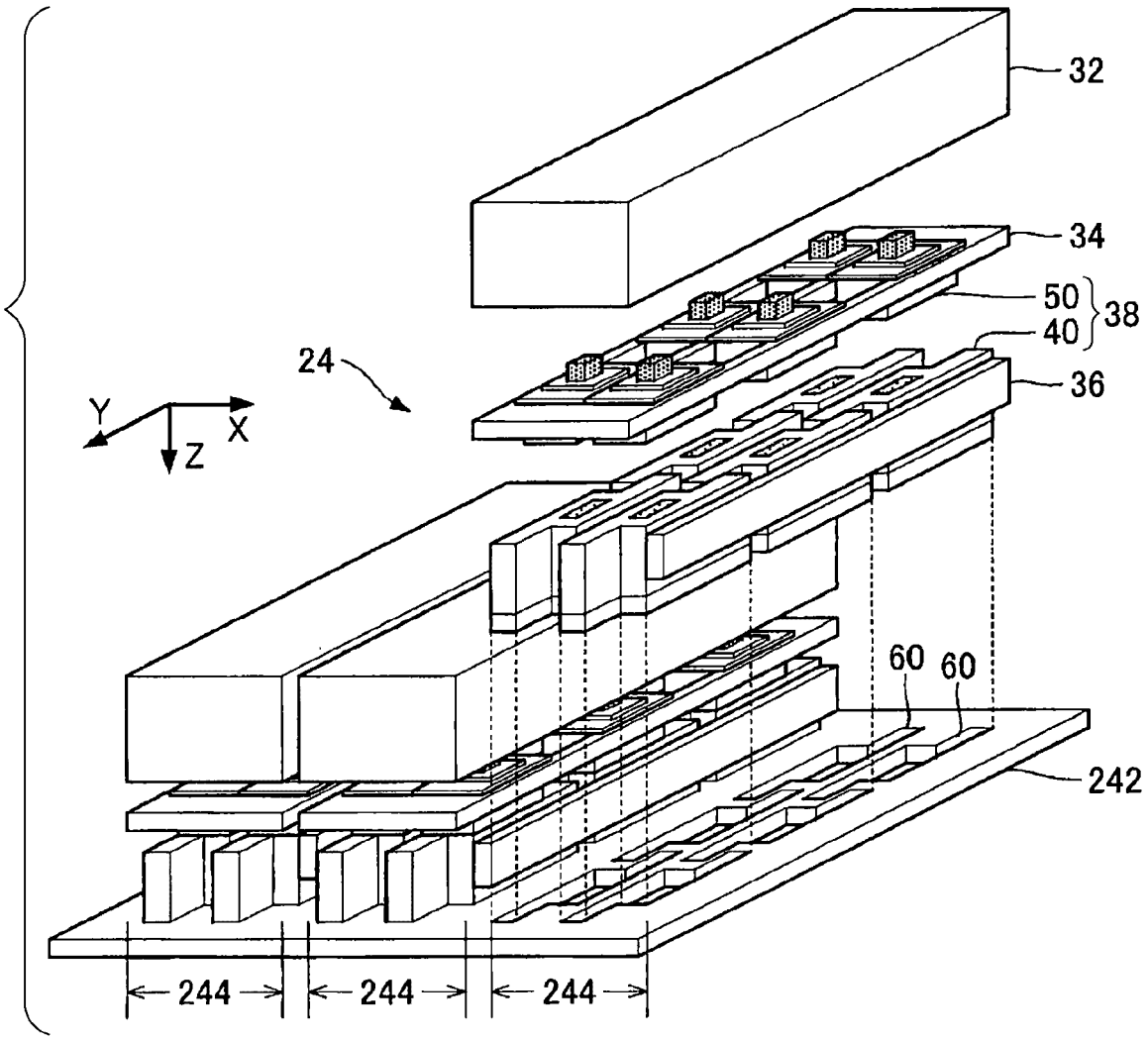
FIG. 2 is an exploded perspective view of a liquid ejecting head.

FIG. 2 is an exploded perspective view of the liquid ejecting head 24. As illustrated in FIG. 2, the liquid ejecting head 24 according to the first embodiment includes a first support body 242 and a plurality of assemblies 244. The first support body 242 is a plate-shaped member that supports the plurality of assemblies 244 (liquid ejecting head support body). The plurality of assemblies 244 are fixed to the first support body 242 in a state of being arranged in the X-direction. As typically illustrated for one of the assemblies 244, each of the plurality of assemblies 244 includes a connection unit 32, a second support body 34, a distribution flow path 36, a plurality of (in the first embodiment, six) liquid ejecting modules 38. The total number of the assemblies 244 that constitute the liquid ejecting head 24 and the total number of the liquid ejecting modules 38 that constitute the assembly 244 are not limited to the example illustrated in FIG. 2.

Figure 3:
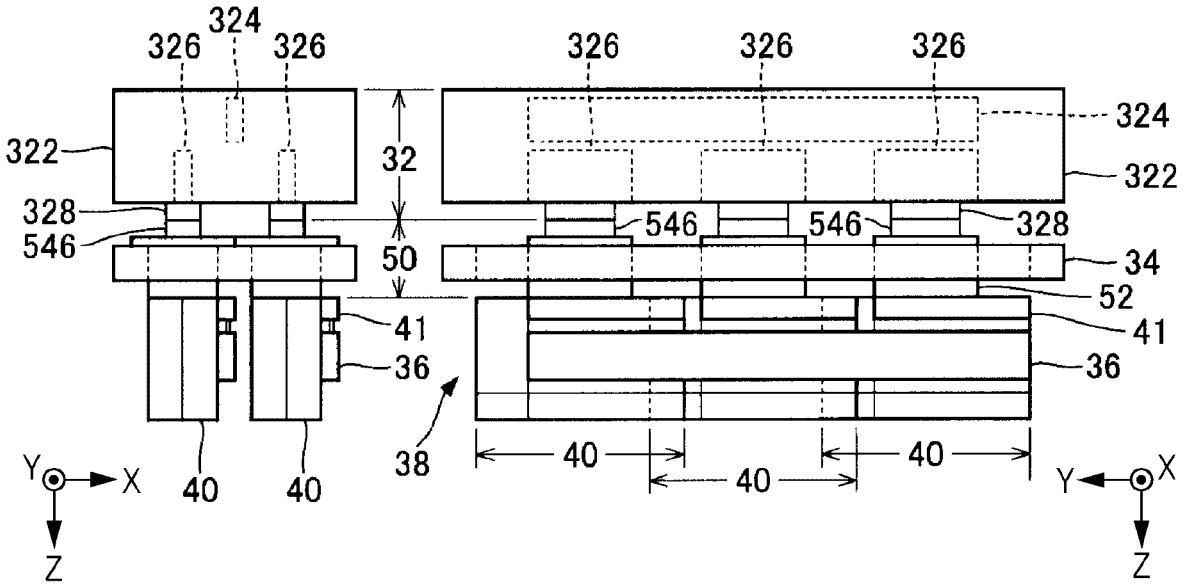
FIG. 3 is a side view of an assembly.

FIG. 3 is a front view and a side view of any one assembly 244. As seen from FIGS. 2 and 3, schematically, the plurality of liquid ejecting modules 38 are disposed in two rows at the second support body 34 that is positioned directly below the connection unit 32, and the distribution flow path 36 is disposed at the side of the plurality of liquid ejecting modules 38. The distribution flow path 36 is a structure in which a flow path for distributing the ink supplied from the liquid container 14 to each of the plurality of liquid ejecting modules 38 is formed, and is configured to elongate in the Y-direction so as to across the plurality of liquid ejecting modules 38.

As illustrated in FIG. 3, the connection unit 32 includes a housing 322, a relay substrate 324, and a plurality of driving substrates 326. The housing 322 is a substantially box-shaped structure that accommodates the relay substrate 324 and the plurality of driving substrates 326. Each of the plurality of driving substrates 326 is a wiring substrate corresponding to each of the liquid ejecting modules 38. A signal generating circuit that generates a driving signal having a predetermined waveform is mounted on the driving substrate 326. A control signal for specifying the presence or absence of the ejection of the ink for each nozzle and a power supply voltage are supplied from the driving substrate 326 to the liquid ejecting module 38 together with the driving signal. An amplifier circuit that amplifies the driving signal may be mounted to the driving substrate 326. The relay substrate 324 is a wiring substrate that relays an electrical signal and the power supply voltage between the control unit 20 and the plurality of driving substrates 326, and is commonly used across the plurality of liquid ejecting modules 38. As illustrated in FIG. 3, a connection portion 328 that is electrically connected to each of the driving substrates 326 (an example of a second connection portion) is provided at the bottom surface of the housing 322. The connection portion 328 is a connector for electrical connection (board-to-board connector).

Figure 4:
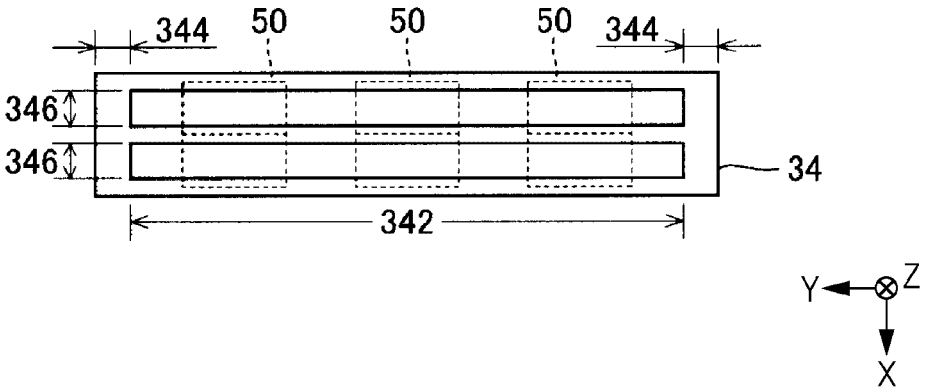
FIG. 4 is a plan view of a second support body.

FIG. 4 is a plan view of the second support body 34. As illustrated in FIGS. 3 and 4, the second support body 34 is a structure (frame) that elongates in the Y-direction, and includes a plurality of (in the example illustrated in FIG. 4, three) support portions 342 that extend in the Y-direction at a distance therebetween in the X-direction, and coupling portions 344 that couple the ends of each of the support portions 342 with each other. In other words, the second support body 34 is a flat plate member in which two opening portions 346 that elongate in the Y-direction are formed at a distance in the X-direction. Each of the coupling portions 344 of the second support body 34 is fixed to the first support body 242 at the position at a distance from the surface of the first support body 242.

Figure 5:
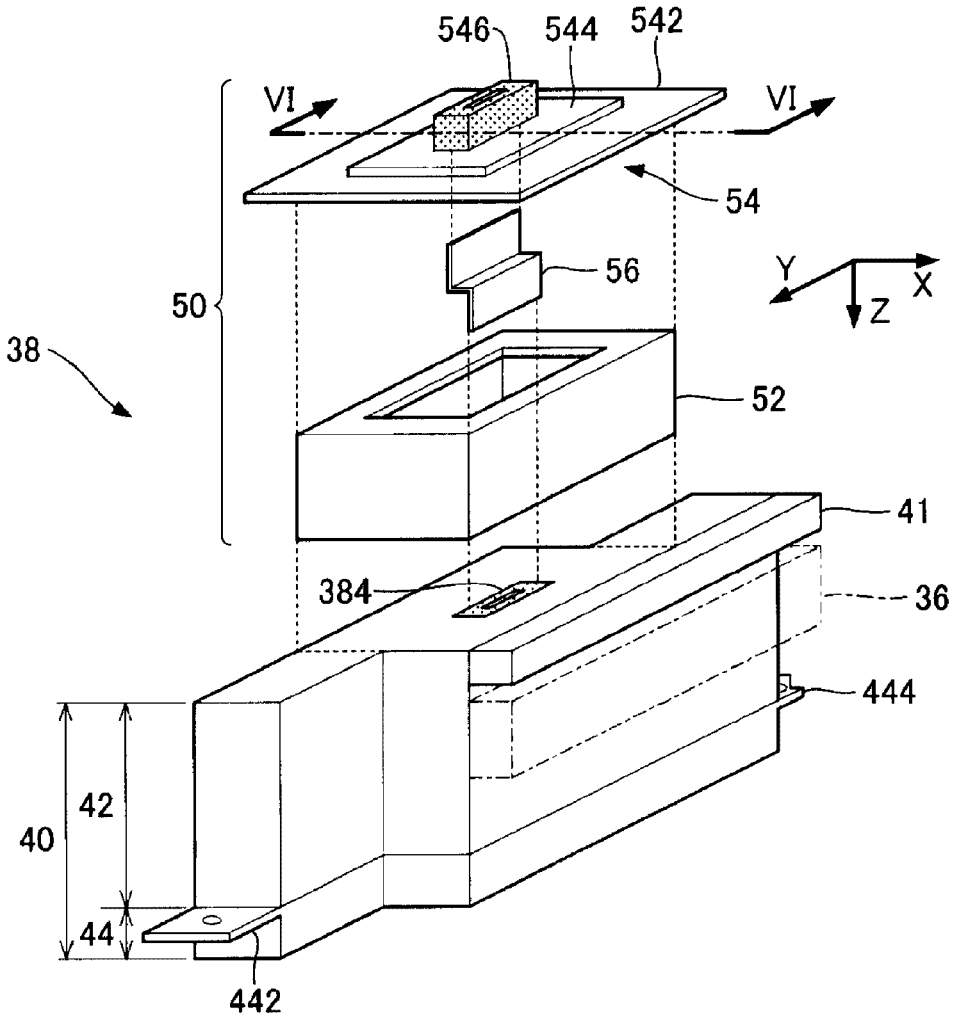
FIG. 5 is an exploded perspective view of a liquid ejecting module.

FIG. 5 is an exploded perspective view of any one liquid ejecting module 38. As illustrated in FIG. 5, the liquid ejecting module 38 according to the first embodiment includes a liquid ejecting unit 40, a coupling unit 50, and a transmission line 56. The liquid ejecting unit 40 ejects the ink supplied from the liquid container 14 via the distribution flow path 36, onto the medium 12. The liquid ejecting unit 40 according to the first embodiment includes a valve mechanism unit 41, a flow path unit 42, and a liquid ejecting portion 44. The valve mechanism unit 41 includes a valve mechanism that controls the opening/closing of the flow path of the ink supplied from the distribution flow path 36. For convenience, the valve mechanism unit 41 is not illustrated in FIG. 2. As illustrated in FIG. 5, the valve mechanism unit 41 according to the first embodiment is provided so as to protrude from the side of the liquid ejecting unit 40 in the X-direction. On the other hand, the distribution flow path 36 is provided on the first support body 242 so as to be opposite to the side of the liquid ejecting unit 40. Therefore, the top surface of the distribution flow path 36 and the bottom surface of each valve mechanism unit 41 are opposite to each other at a distance therebetween in the Z-direction. In the above configuration, the flow path in the distribution flow path 36 and the flow path in the valve mechanism unit 41 communicate with each other.

The liquid ejecting portion 44 of the liquid ejecting unit 40 ejects the ink from a plurality of nozzles. The flow path unit 42 is a structure in which the flow path for supplying the ink passed through the valve mechanism unit 41 to the liquid ejecting portion 44 is formed therein. On the top surface of the liquid ejecting unit 40 (specifically, the top surface of the flow path unit 42), a connection portion 384 that electrically connects the liquid ejecting unit 40 to the driving substrate 326 of the connection unit 32 is provided. The coupling unit 50 is a structure that connects the liquid ejecting unit 40 to the second support body 34. The transmission line 56 illustrated in FIG. 5 is, for example, a flexible cable such as a flexible flat cable (FFC), flexible printed circuits (FPC), or the like.

Figure 6:
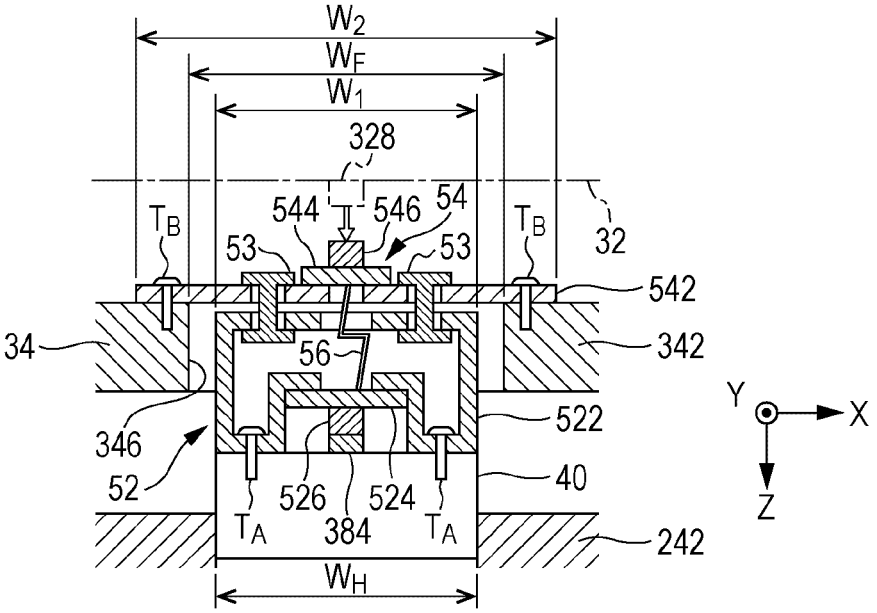
FIG. 6 is a sectional view of the liquid ejecting module (sectional view taken along line VI-VI in FIG. 5).

FIG. 6 is a sectional view taken along line VI-VI in FIG. 5. As illustrated in FIGS. 5 and 6, the coupling unit 50 according to the first embodiment includes a first relay body 52 and a second relay body 54.

The first relay body 52 is a structure that is fixed to the liquid ejecting unit 40, and includes a housing body 522 and a wiring substrate 524 (an example of a second wiring substrate). The housing body 522 is a substantially box-shaped housing. As illustrated in FIG. 6, the liquid ejecting unit 40 is fixed to the bottom surface side of the housing body 522 (positive Z-direction) by fasteners TA such as, for example, a screw or the like. The wiring substrate 524 is a flat plate-shaped wiring substrate that constitutes the bottom surface of the housing body 522. A connection portion 526 (an example of a third connection portion) is provided on the surface of the wiring substrate 524 at the side of the liquid ejecting unit 40. The connection portion 526 is a connector for electrical connection (board-to-board connector). In a state where the first relay body 52 is fixed to the liquid ejecting unit 40, the connection portion 526 of the wiring substrate 524 is detachably coupled to the connection portion 384 of the liquid ejecting unit 40.

The second relay body 54 is a structure that fixes the liquid ejecting module 38 to the second support body 34 and electrically connects the liquid ejecting module 38 to the driving substrate 326, and includes a mounting substrate 542 and a wiring substrate 544 (an example of a first wiring substrate). The mounting substrate 542 is a plate-shaped member that is fixed to the second support body 34. As illustrated in FIG. 6, the housing body 522 of the first relay body 52 and the mounting substrate 542 of the second relay body 54 are coupled to each other by couplers 53. The coupler 53 is a pin in which both end portions of a cylindrical shaft body are molded in a flange shape, and is inserted into the through-holes that are formed at each of the first relay body 52 and the second relay body 54. The diameter of the shaft body of the coupler 53 is less than the internal diameter of the through-hole of each of the first relay body 52 and the second relay body 54. Therefore, a gap is formed between the outer peripheral surface of the shaft body of the coupler 53 and the inner peripheral surface of the through-hole, and the first relay body 52 and the second relay body 54 are coupled to each other in an unrestrained manner. In other words, one of the first relay body 52 and the second relay body 54 can be moved in the X-Y plane with respect to the other by the amount of the gap between the coupler 53 and the through-hole.

As illustrated in FIG. 6, the dimension $W_2$ in the X-direction of the second relay body 54 (the mounting substrate 542) is greater than the dimension $W_1$ in the X-direction of the first relay body 52 (the housing body 522). Therefore, the edge portions of the mounting substrate 542 that are positioned at the both sides in the X-direction protrude from the sides of the first relay body 52 to the positive X-direction and the negative X-direction. The dimension $W_2$ of the second relay body 54 is greater than the dimension $W_F$ in the X-direction of the opening portion 346 of the second support body 34 ($W_2>W_F$). The portions of the mounting substrate 542 that protrude from the housing body 522 are fixed to the top surface of the support portion 342 in the second support body 34 by fasteners $T_B$ (in the example illustrated in FIG. 6, a plurality of screws). On the other hand, the dimension $W_1$ in the X-direction of the first relay body 52 is less than the dimension $W_F$ of the opening portion 346 of the second support body 34 ($W_1<W_F$). Therefore, as illustrated in FIG. 6, a gap is formed between the outer wall surface of the first relay body 52 (housing body 522) and the inner wall surface of the opening portion 346 of the second support body 34. In other words, in a state of the pre-installation of the first relay body 52 to the second support body 34, the first relay body 52 can pass through the opening portion 346 of the second support body 34. As can be understood from the above description, the second relay body 54 is fixed to the second support body 34, and the first relay body 52 is coupled to the second relay body 54 in an unrestrained manner. Thus, the second relay body 54 can move slightly in the X-Y plane with respect to the second support body 34.

The wiring substrate 544 is a plate-shaped member that is fixed to the surface of the mounting substrate 542 on the side opposite to the first relay body 52. A connection portion 546 (an example of a first connection portion) is provided on the surface of the wiring substrate 544 at the connection unit 32 side (negative Z-direction side). In other words, the connection portion 546 is fixed to the second support body 34 via the wiring substrate 544 and the mounting substrate 542. The connection portion 546 is a connector for electrical connection (board-to-board connector). Specifically, in a state where the second support body 34 is fixed to the connection unit 32, the connection portion 546 of the wiring substrate 544 is detachably coupled to the connection portion 328 of the connection unit 32. In other words, the connection portion 328 of the connection unit 32 can be attached and detached to and from the connection portion 546 from the side opposite to the liquid ejecting unit 40 (negative Z-direction side).

As illustrated in FIG. 6, the transmission line 56 is placed over the wiring substrate 544 and the wiring substrate 524, and electrically connects the connection portion 546 and the connection portion 526. As illustrated in FIGS. 5 and 6, the transmission line 56 is accommodated in the housing body 522 in a state of being bent along a straight line parallel to the X-direction between the connection portion 546 and connection portion 526. One end of the transmission line 56 is bonded to the surface of the wiring substrate 544 that is opposite to the wiring substrate 524, and electrically connected to the connection portion 546. The other end of the transmission line 56 is bonded to the surface of the wiring substrate 524 that is opposite to the wiring substrate 544, and electrically connected to the connection portion 526.

As can be understood from the above description, the driving substrate 326 of the connection unit 32 is electrically connected to the connection portion 384 of the liquid ejecting unit 40 via the connection portion 328, the connection portion 546, the wiring substrate 544, the transmission line 56, the wiring substrate 524, and the connection portion 526. Therefore, the electrical signal generated in the driving substrate 326 (driving signal, control signal) and the power supply voltage are supplied to the liquid ejecting unit 40 via the connection portion 328, the connection portion 546, the transmission line 56, and the connection portion 526.

However, for example, in a case where the position of each of the plurality of connection portions 546 is determined by the relative relationship between the connection portions 546 and the position of each of the plurality of liquid ejecting units 40 is determined by the relative relationship between the liquid ejecting units 40, there is a case where a position error between the connection portion 546 and the liquid ejecting unit 40 occurs. In the first embodiment, the transmission line 56 is a flexible member, and can be easily deformed. Thus, the position error between the connection portion 546 and the liquid ejecting unit 40 is absorbed by the deformation of the transmission line 56. In other words, the transmission line 56 according to the first embodiment functions as a connector body for coupling the connection portion 546 and the liquid ejecting unit 40 so as to absorb the position error between the connection portion 546 and the liquid ejecting unit 40.

According to the above configuration, in a step of attaching and detaching the connection portion 328 of the connection unit 32 to and from the connection portion 546, the stress that is applied from the connection portion 546 to the liquid ejecting unit 40 is reduced. Therefore, it is possible to easily assemble or disassemble the liquid ejecting head 24 without considering the stress that is applied from the connection portion 546 to the liquid ejecting unit 40 (further the position deviation of the liquid ejecting unit 40). In the first embodiment, as described above, since the transmission line 56 is bent between the connection portion 546 and the liquid ejecting unit 40, the effect that can absorb the position error between the connection portion 546 and the liquid ejecting unit 40 is particularly remarkable.

Figure 7:
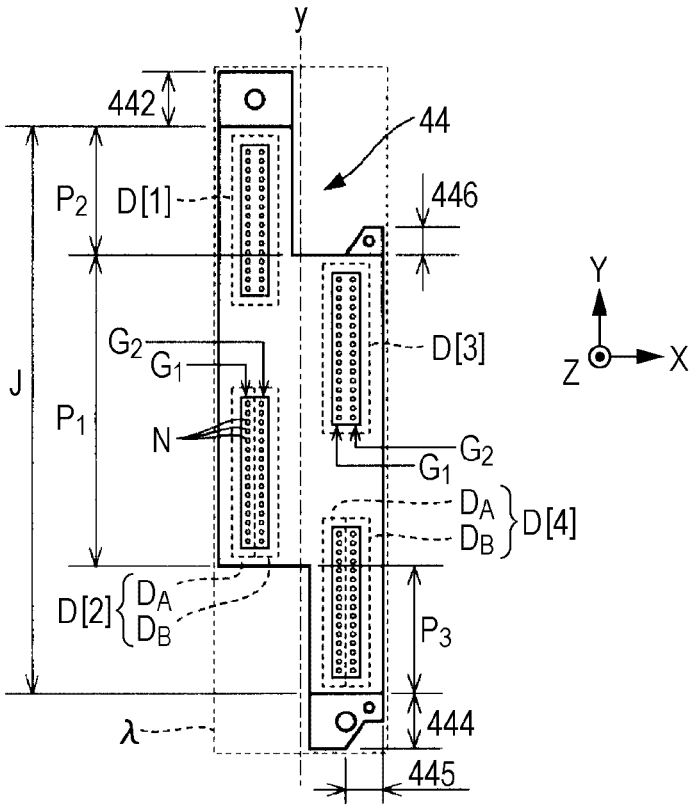
FIG. 7 is a plan view of an ejecting face.

FIG. 7 is a plan view of the surface of the liquid ejecting portion 44 that is opposite to the medium 12 (that is, a plan view of the liquid ejecting portion 44 when viewed from the positive Z-direction). As illustrated in FIG. 7, a plurality of nozzles (ejecting holes) N are formed on the face J of the liquid ejecting portion 44 that is opposite to the medium 12 (hereinafter, referred to as the "ejecting face"). As illustrated in FIG. 7, the liquid ejecting portion 44 according to the first embodiment includes four driving portions D[1] to D[4] each of which includes the plurality of nozzles N formed on the ejecting face J. The range in the Y-direction in which the plurality of nozzles N are distributed partially overlaps between the two driving portions D[n] (n=1 to 4).

As illustrated in FIG. 7, the plurality of nozzles N corresponding to any one driving portion D[n] are divided into a first column $G_1$ and a second column $G_2$. Each of the first column $G_1$ and the second column $G_2$ is a set of the plurality of nozzles N arranged along the Y-direction. The first column $G_1$ and the second column $G_2$ are disposed in parallel at a distance therebetween in the X-direction. Each driving portion D[n] includes a first ejecting portion $D_A$ that ejects the ink from each of the nozzles N of the first column $G_1$, and a second ejecting portion $D_B$ that ejects the ink from each of the nozzles N of the second column $G_2$. In each of the nozzles N of the first column $G_1$ and each of the nozzles N of the second column $G_2$, the position in the Y-direction can be also changed (so-called staggered arrangement or zigzag arrangement). The number of the driving portions D[n] that are provided in the liquid ejecting portion 44 is arbitrary, and not limited to four.

As illustrated in FIG. 7, assuming that there is a rectangle λ that has a minimum area including the ejecting face J, the center line y parallel to the long side (Y-direction) of the rectangle λ can be set. As illustrated in FIG. 7, the planar shape of the ejecting face J according to the first embodiment is a shape obtained by connecting a first portion $P_1$, a second portion $P_2$, and a third portion $P_3$ in the Y-direction (that is, the direction of the long side of the rectangle λ). The second portion $P_2$ is positioned at the side in the positive Y-direction when viewed from the first portion $P_1$, and the third portion $P_3$ is positioned at the side opposite to the second portion $P_2$ interposing the first portion $P_1$ (negative Y-direction). As can be understood from FIG. 7, the first portion $P_1$ passes through the center line y of the rectangle λ, but each of the second portion $P_2$ and the third portion $P_3$ do not pass through the center line y. Specifically, the second portion $P_2$ is positioned at the side in the negative X-direction when viewed from the center line y, and the third portion $P_3$ is positioned at the side in the positive X-direction when viewed from the center line y. That is, the second portion $P_2$ is positioned at the side opposite to the third portion $P_3$ interposing the center line y. The planar shape of the ejecting face J can be expressed as a shape in which the second portion $P_2$ is continuous to the edge side of the first portion $P_1$ in the negative X-direction and the third portion $P_3$ is continuous to the edge side of the first portion $P_1$ in the positive X-direction.

As illustrated in FIGS. 5 and 7, a protruding portion 442 and a protruding portion 444 are formed at the end surfaces of the liquid ejecting portion 44. The protruding portion 442 is a flat plate-shaped portion which protrudes from the end surface of the liquid ejecting portion 44 at the end portion of the second portion $P_2$ that is opposite to the first portion $P_1$ (the positive Y-direction). On the other hand, the protruding portion 444 is a flat plate-shaped portion which protrudes from the end surface of the liquid ejecting portion 44 at the end portion of the third portion $P_3$ that is opposite to the first portion $P_1$ (the negative Y-direction). As illustrated in FIG. 7, a projection portion 446 is formed at the edge side of the first portion $P_1$ at the second portion $P_2$ side (edge side at which the second portion $P_2$ is not present). The projection portion 446 is a flat plate-shaped portion (an example of a first protruding portion) which projects from the side surface of the liquid ejecting portion 44, in the same manner as those of the protruding portion 442 and the protruding portion 444. A notch portion 445 that has a shape corresponding to the projection portion 446 is formed at the protruding portion 444 (an example of a second protruding portion).

Figure 8:
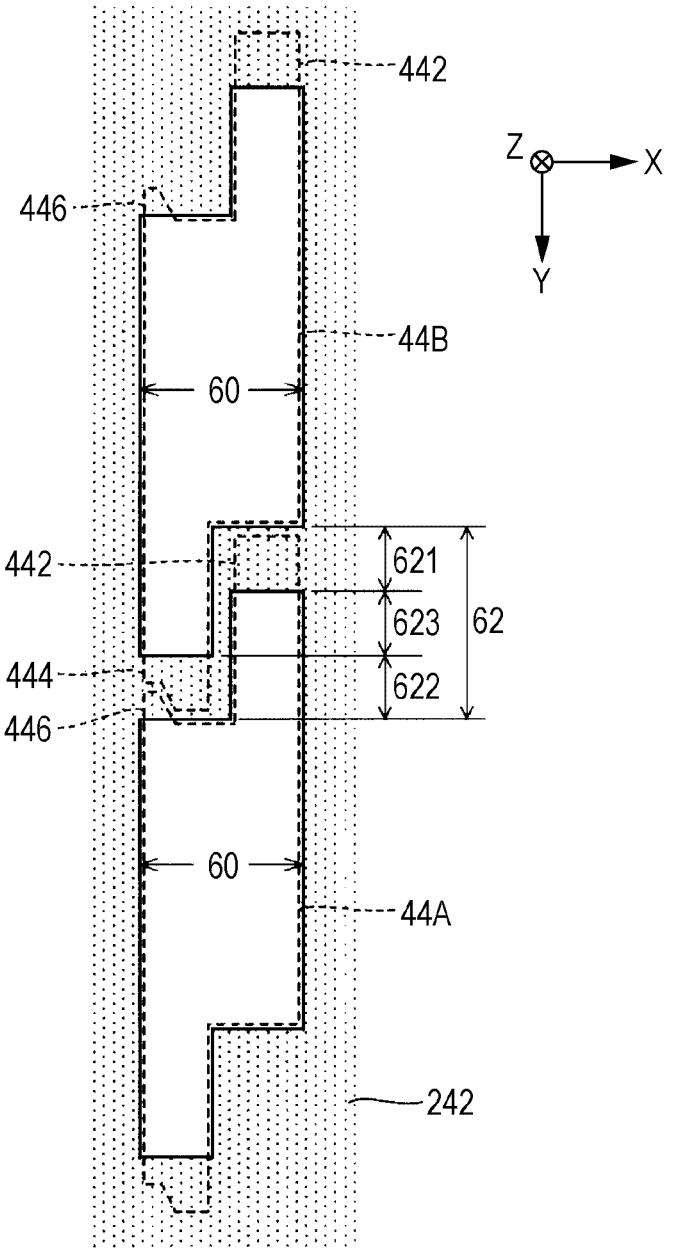
FIG. 8 is a plan view of a first support body.
Figure 9:
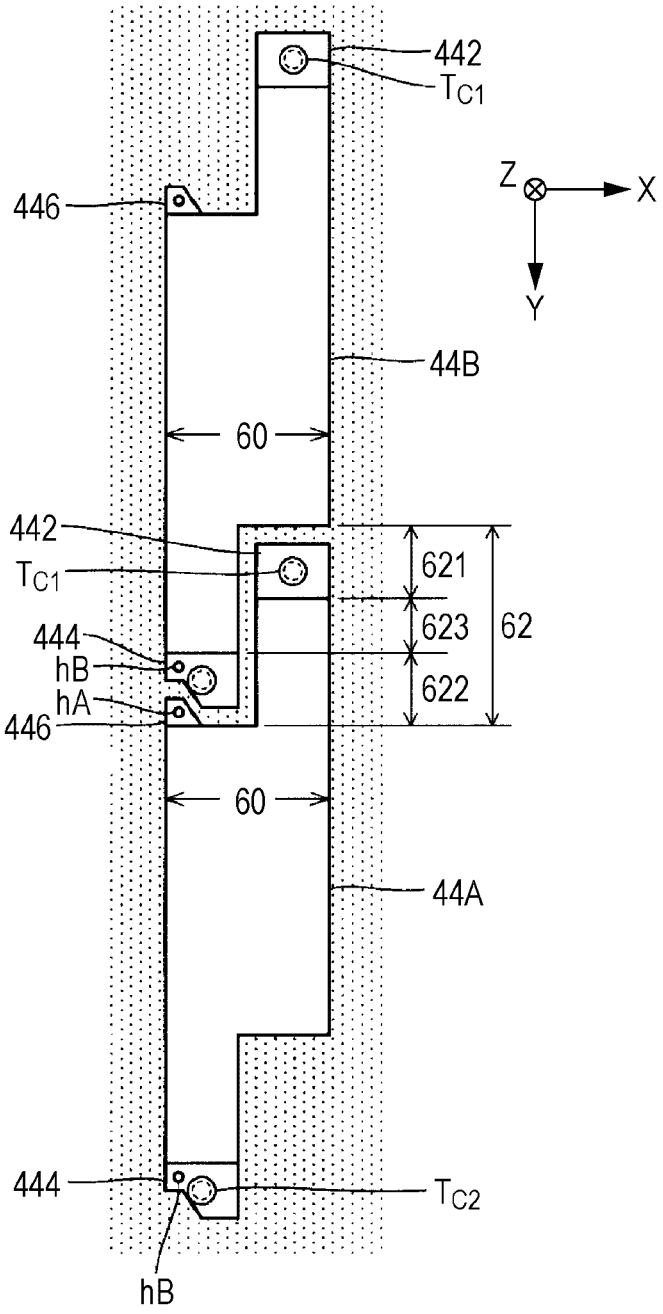
FIG. 9 is an explanatory view illustrating a state where a plurality of liquid ejecting units are fixed to the first support body.

FIG. 8 is a plan view of the surface (surface in the negative Z-direction) of the first support body 242, and FIG. 9 is a plan view in which the liquid ejecting portion 44 is additionally illustrated in FIG. 8. In FIGS. 8 and 9, the range in which two liquid ejecting portions 44 ($44_A$, $44_B$) that are adjacent with each other in the Y-direction are positioned is illustrated for convenience. As illustrated in FIGS. 8 and 9, opening portions 60 corresponding to each of the liquid ejecting portions 44 (each of the liquid ejecting modules 38) are formed in the first support body 242. Specifically, as can be understood from FIG. 2, six opening portions 60 corresponding to each of the liquid ejecting portions 44 are formed for each of the assemblies 244, and disposed in parallel in the Y-direction so as to correspond to the arrangement of the plurality of assemblies 244. As illustrated in FIGS. 8 and 9, each of the opening portions 60 is a through-hole that has a planar shape corresponding to the outer shape of the ejecting face J of the liquid ejecting portion 44. The liquid ejecting unit 40 is fixed to the first support body 242 in a state where the liquid ejecting portion 44 is inserted into the opening portion 60 of first support body 242. In other words, the ejecting face J of the liquid ejecting portion 44 is exposed from the first support body 242 in the positive Z-direction through the inner side of the opening portion 60.

As illustrated in FIGS. 8 and 9, a beam-shaped portion 62 is formed between two opening portions 60 that are adjacent with each other in the Y-direction. Any one beam-shaped portion 62 is a beam-shaped portion in which a first support portion 621, a second support portion 622, and an intermediate portion 623 are coupled to each other. The first support portion 621 is a portion that is positioned at the side of the beam-shaped portion 62 in the negative Y-direction, and the second support portion 622 is a portion that is positioned at the side of the beam-shaped portion 62 in the positive Y-direction. The intermediate portion 623 is a portion that couples the first support portion 621 and the second support portion 622.

As can be understood from FIG. 9, the protruding portion 442 of each liquid ejecting portion 44 overlaps with the first support portion 621 of the beam-shaped portion 62 in a plan view (that is, when viewed from a direction parallel to the Z-direction), and the protruding portion 444 of each liquid ejecting portion 44 overlaps with the second support portion 622 of the beam-shaped portion 62 in a plan view. The protruding portion 442 is fixed to the first support portion 621 by a fastener $T_{C1}$, and the protruding portion 444 is fixed to the second support portion 622 by a fastener $T_{C2}$. Thus, the liquid ejecting portion 44 is fixed to the first support body 242. The fastener $T_{C1}$ and the fastener $T_{C2}$ are a screw, for example. As described above, since the liquid ejecting portion 44 (liquid ejecting unit 40) is fixed to the first support body 242 at both ends of the ejecting face J, it is possible to effectively suppress the inclination of the liquid ejecting portion 44 with respect to the first support body 242. As illustrated in FIG. 9, focusing on the opening portion 60 corresponding to the liquid ejecting portion $\mathbf{44}_A$ and the opening portion 60 corresponding to the liquid ejecting portion $\mathbf{44}_B$, the protruding portion 442 of the liquid ejecting portion $\mathbf{44}_A$ is fixed to the first support portion 621 of the beam-shaped portion 62 between the opening portions 60, and the protruding portion 444 of the liquid ejecting portion $\mathbf{44}_B$ is fixed to the second support portion 622 of the beam-shaped portion 62.

An engagement hole hA is formed in the projection portion 446 of each liquid ejecting portion 44, and an engagement hole hB is formed in the protruding portion 444 together with a through-hole into which the fastener $T_{C2}$ is inserted. The engagement hole hA and the engagement hole hB are through-holes that engage with the projections provided on the surface of the first support body 242 (an example of a positioning portion). The projections of the surface of the first support body 242 engage with each of the engagement hole hA and the engagement hole hB, and thus the position of the liquid ejecting portion 44 in the X-Y plane is determined. That is, the alignment of the liquid ejecting portion 44 with respect to the first support body 242 is realized. As illustrated in FIG. 9, the engagement hole hA of the projection portion 446 and the engagement hole hB of the protruding portion 444 are positioned on a straight line parallel to the Y-direction (center line y). Accordingly, there is an advantage in that the liquid ejecting portion 44 can be positioned on the first support body 242 with high accuracy while suppressing the inclination of the liquid ejecting portion 44 (liquid ejecting unit 40). In addition, the liquid ejecting portion 44 may also be aligned on the first support body 242 by engaging the projections formed on the protruding portion 444 and the projection portion 446 with the engagement holes (bottomed holes or through-holes) of the surface of the first support body 242.

Figure 10:
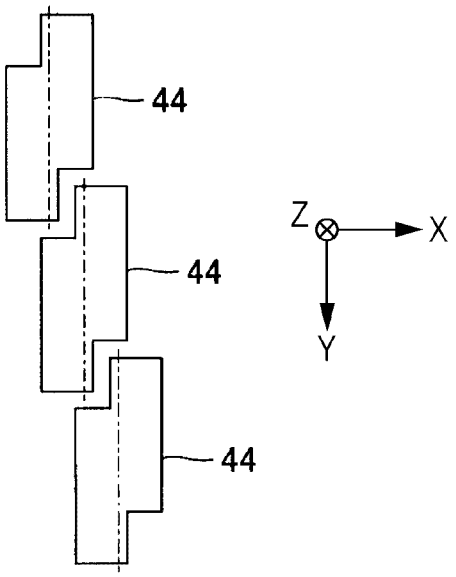
FIG. 10 is an explanatory view illustrating a comparative example.

As described above, in the first embodiment, the beam-shaped portion 62 is formed between the two opening portions 60 that are adjacent in the Y-direction, and thus there is an advantage in that the size of the first support body 242 in the X-direction can be reduced. In addition, in the first embodiment, the intermediate portion 623 is formed in the beam-shaped portion 62, and thus it is possible to maintain the mechanical strength of the first support body 242, compared to the configuration in which the opening portions 60 that expose the ejecting face J of the liquid ejecting portion 44 are continuous over the plurality of liquid ejecting portions 44 (configuration in which the beam-shaped portion 62 is not formed). In the configuration in which the second portion $P_2$ and the third portion $P_3$ of the ejecting face J pass through the center line y (hereinafter, referred to as a "comparative example"), in order to dispose the plurality of liquid ejecting portions 44 at the positions that are close enough in the Y-direction, as illustrated in FIG. 10, it is necessary that the position in the X-direction of each of the liquid ejecting portions 44 is made different from each other. In first embodiment, the second portion $P_2$ and the third portion $P_3$ do not pass through the center line y, and thus, as illustrated FIG. 9, it is possible to arrange the plurality of liquid ejecting portions 44 in a linear shape along the Y-direction. Accordingly, there is an advantage in that the size in the width direction of the liquid ejecting head 24 (one assembly 244) can be reduced compared to the comparative example.

Figure 11:
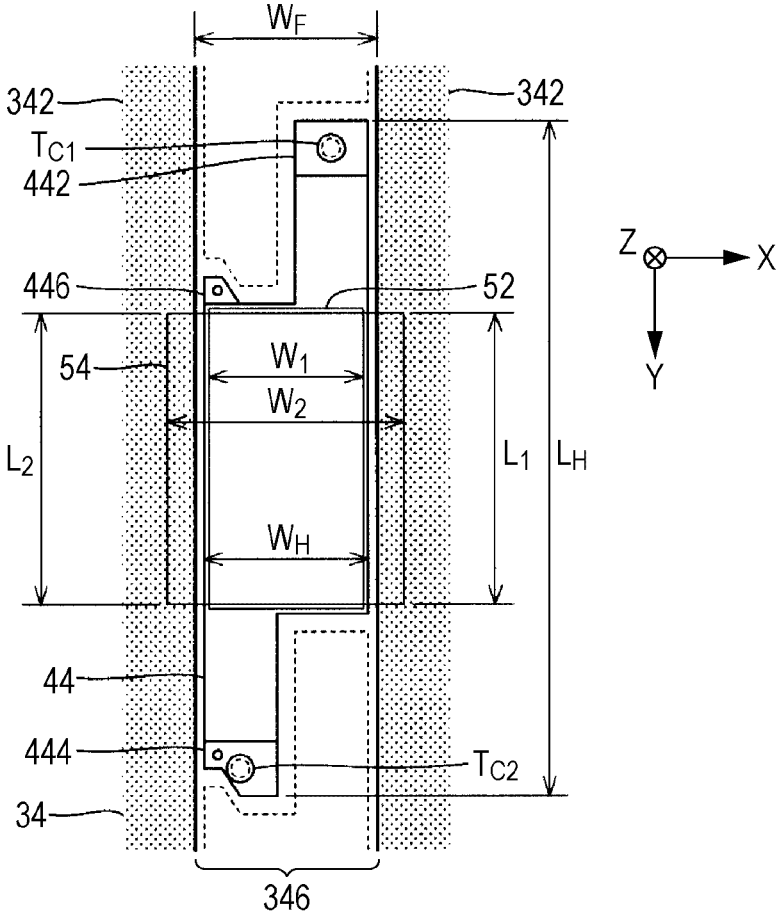
FIG. 11 is an explanatory view illustrating the relationship between an opening portion of the second support body and the liquid ejecting module.

FIG. 11 is a plan view illustrating the relationship among the liquid ejecting unit 40, the coupling unit 50, and the second support body 34. As illustrated in FIG. 11, the dimension $W_H$ in the X-direction of the liquid ejecting unit 40 is less than the dimension $W_F$ in the X-direction of the opening portion 346 of the second support body 34 ($W_H<W_F$). As described above with reference to FIG. 6, since the dimension $W_1$ of the first relay body 52 is also less than the dimension $W_F$ of the opening portion 346, the liquid ejecting unit 40 and the first relay body 52 can pass through the opening portion 346 of the second support body 34. As described above, it is possible to attach and detach the liquid ejecting unit 40 and the second relay body 54 by passing through the opening portion 346 of the second support body 34. Thus, according to the first embodiment, it is possible to reduce the burden in the assembly and disassembly of the liquid ejecting head 24.

As illustrated in FIG. 11, the dimension $L_1$ in the Y-direction of the first relay body 52 and the dimension $L_2$ in the Y-direction of the second relay body 54 are less than the dimension $L_H$ in the Y-direction of the liquid ejecting unit 40 ($L_1<L_H$, $L_2<L_{11}$). Therefore, in a state where the outer wall surfaces of the both sides in the Y-direction of the first relay body 52 are held with fingers, it is possible to easily attach and detach the liquid ejecting module 38 to and from the second support body 34. As illustrated in FIG. 11, the first relay body 52 and the second relay body 54 do not overlap with the fastener $T_{C1}$ and the fastener $T_{C2}$ for fixing the liquid ejecting unit 40 to the first support body 242 in a plan view. Therefore, there is an advantage in that the work for fixing the liquid ejecting unit 40 to the first support body 242 by the fastener $T_{C1}$ and the fastener $T_{C2}$ is easy.

Figure 12:
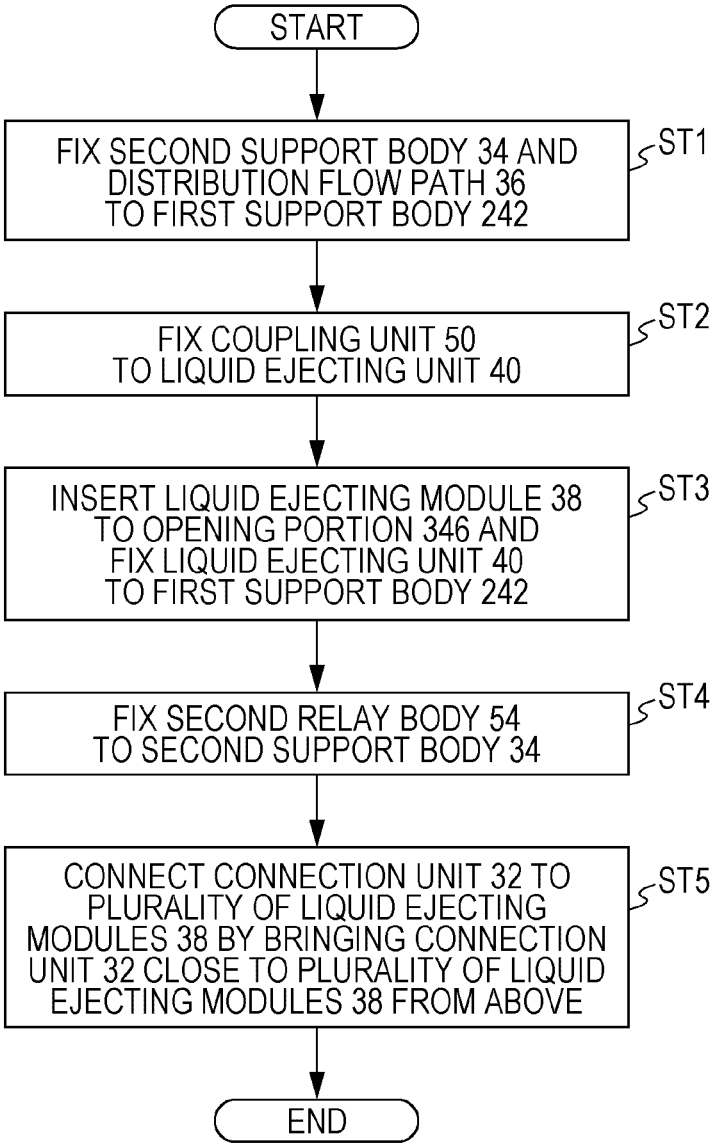
FIG. 12 is an explanatory diagram illustrating a method for manufacturing the liquid ejecting head.

FIG. 12 is a flowchart of a method for manufacturing the liquid ejecting head 24. As illustrated in FIG. 12, first, the second support body 34 and the distribution flow path 36 are fixed to the first support body 242 (ST1). On the other hand, the liquid ejecting module 38 is assembled by fixing the coupling unit 50 to the liquid ejecting unit 40 using the fasteners $T_A$ (ST2). Step ST2 may be executed before step ST1 is executed.

In step ST3 after step ST1 and step ST2 are executed, for each of the plurality of liquid ejecting modules 38, the liquid ejecting module 38 is inserted from the side opposite to the first support body 242 to the opening portion 346 of the second support body 34, and the liquid ejecting unit 40 is fixed to the first support body 242 by the fastener $T_{C1}$ and the fastener $T_{C2}$ (ST3). In the process in which the liquid ejecting module 38 is inserted to the opening portion 346 and brought close to the first support body 242, the valve mechanism unit 41 and the distribution flow path 36 communicate with each other. In step ST4 after step ST3 is executed, for each of the plurality of liquid ejecting modules 38, the second relay body 54 of the coupling unit 50 is fixed to the second support body 34 by the fasteners $T_B$. Step ST4 may be executed before step ST3 is executed.

In step ST5 after step ST3 and step ST4 are executed, the connection unit 32 is brought close to each of the liquid ejecting modules 38 interposing the coupling unit 50, from the side opposite to the liquid ejecting unit 40 (negative Z-direction). The connection portion 546 and the connection portion 328 of the connection unit 32 are collectively and detachably connected to the plurality of liquid ejecting modules 38.

According to the above steps (ST1 to ST5), one assembly 244 including the connection unit 32, the second support body 34, the distribution flow path 36, and the plurality of liquid ejecting modules 38 is provided on the first support body 242. The plurality of assemblies 244 are fixed to the first support body 242 by repeating the same step, and thus the liquid ejecting head 24 illustrated in FIG. 2 is manufactured.

As can be understood from the above description, step ST3 is a step of fixing the liquid ejecting unit 40 to the first support body 242, and step ST4 is a step of fixing the coupling unit 50 to the second support body 34. Step ST5 is a step of detachably connecting the connection portion 546 and the connection portion 328 by bringing the connection unit 32 close to the plurality of liquid ejecting modules 38. The manufacturing method of the liquid ejecting head 24 is not limited to the method described above.

Figure 13:
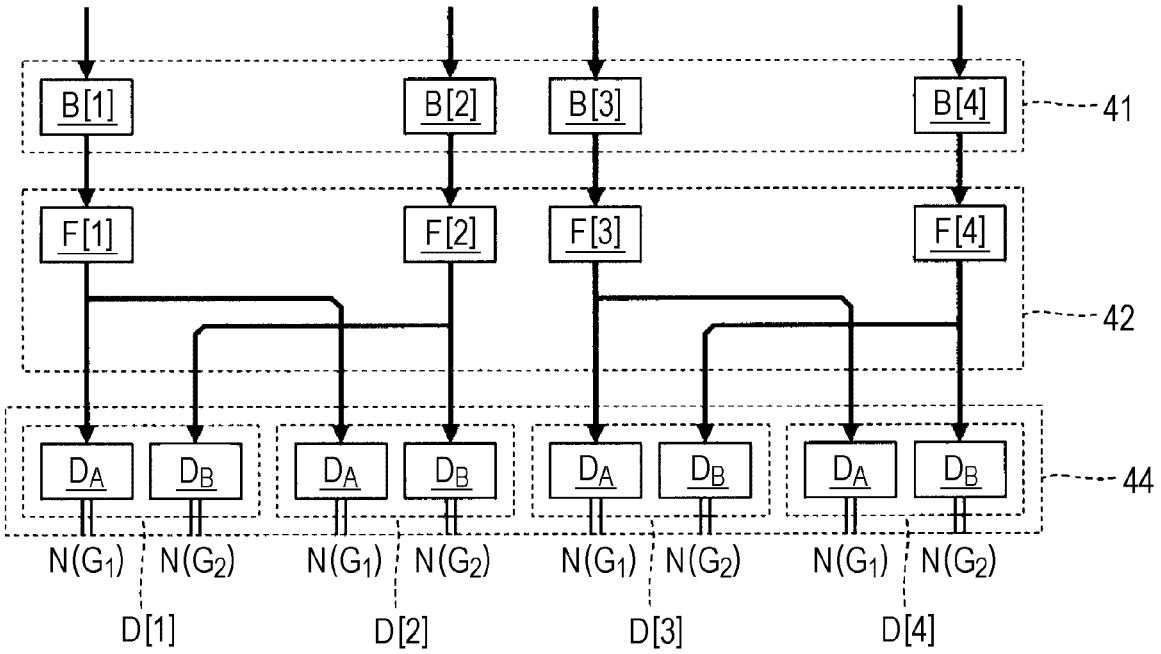
FIG. 13 is an explanatory diagram illustrating a flow path for supplying ink to a liquid ejecting portion.

The specific configuration of the liquid ejecting unit 40 described above will be described. FIG. 13 is an explanatory diagram of the flow path for supplying the ink to the liquid ejecting unit 40. As described above with reference to FIG. 5, the liquid ejecting portion 44 of the liquid ejecting unit 40 includes four driving portions D[1] to D[4]. Each driving portion D[n] includes a first ejecting portion $D_A$ that ejects the ink from each nozzle N of the first column $G_1$, and a second ejecting portion $D_B$ that ejects the ink from each nozzle N of the second column $G_2$. As illustrated in FIG. 13, the valve mechanism unit 41 includes four opening/closing valves B[1] to B[4], and the flow path unit 42 of the liquid ejecting unit 40 includes four filters F[1] to F[4]. The opening/closing valve B[n] is a valve mechanism that opens and closes the flow path for supplying the ink to the liquid ejecting portion 44. The filter F[n] collects air bubbles or foreign matters mixed into the ink in the flow path.

As illustrated in FIG. 13, the ink that passes through the opening/closing valve B[1] and the filter F[1] is supplied to the first ejecting portions $D_A$ of the driving portion D[1] and the driving portion D[2], and the ink that passes through the opening/closing valve B[2] and the filter F[2] is supplied to the second ejecting portions $D_B$ of the driving portion D[1] and the driving portion D[2]. Similarly, the ink that passes through the opening/closing valve B[3] and the filter F[3] is supplied to the first ejecting portions $D_A$ of the driving portion D[3] and the driving portion D[4], and the ink that passes through the opening/closing valve B[4] and the filter F[4] is supplied to the second ejecting portions $D_B$ of the driving portion D[3] and the driving portion D[4]. In other words, the ink that passes through the opening/closing valve B[1] or the opening/closing valve B[3] is ejected from each nozzle N of the first column $G_1$, and the ink that passes through the opening/closing valve B[2] or the opening/closing valve B[4] is ejected from each nozzle N of the second column $G_2$.

Figure 14:
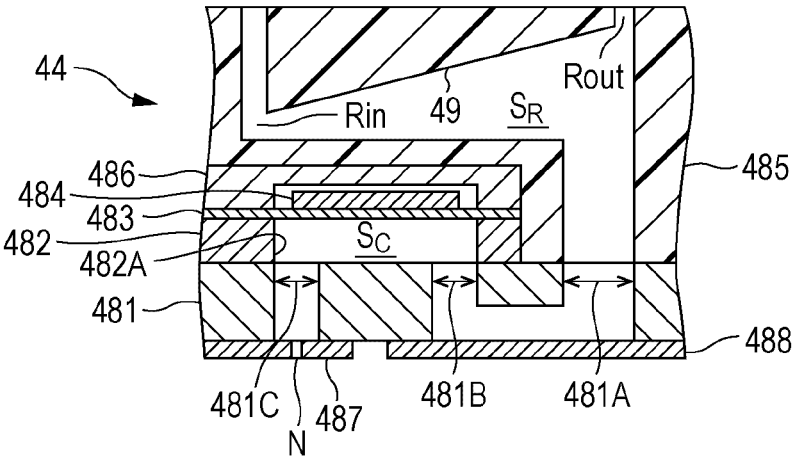
FIG. 14 is a sectional view of the liquid ejecting portion.

FIG. 14 is a sectional view of the portion corresponding to any one nozzle N of the liquid ejecting portion 44 (first ejecting portion $D_A$ or second ejecting portion $D_B$). As illustrated in FIG. 14, the liquid ejecting portion 44 according to the first embodiment is a structure in which a pressure chamber substrate 482, a vibration plate 483, a piezoelectric element 484, a housing portion 485, and a sealing body 486 are disposed on one side of a flow path substrate 481, and in which a nozzle plate 487 and a buffer plate 488 are disposed on the other side of the flow path substrate 481. The flow path substrate 481, the pressure chamber substrate 482, and the nozzle plate 487 are formed with, for example, a flat plate member of silicon, and the housing portion 485 is formed, for example, by injection molding of a resin material. The plurality of nozzles N are formed in the nozzle plate 487. The surface of the nozzle plate 487 that is opposite to the flow path substrate 481 corresponds to the ejecting face J.

In the flow path substrate 481, an opening portion 481A, and a branch flow path (throttle flow path) 481B, and a communication flow path 481C are formed. The branch flow path 481B and the communication flow path 481C are a through-hole that is formed for each of the nozzles N, and the opening portion 481A is an opening that is continuous across the plurality of nozzles N. The buffer plate 488 is a flat plate member which is provided on the surface of the flow path substrate 481 that is opposite to the pressure chamber substrate 482 and closes the opening portion 481A (a compliance substrate). The pressure variation in the opening portion 481A is absorbed by the buffer plate 488.

In the housing portion 485, a common liquid chamber (reservoir) $S_R$ that communicates with the opening portion 481A of the flow path substrate 481 is formed. The common liquid chamber $S_R$ is a space for storing the ink to be supplied to the plurality of nozzles N that constitute one of the first column $G_1$ and the second column $G_2$, and is continuous across the plurality of nozzles N. An inflow port $R_{in}$ into which the ink supplied from the upstream side flows is formed in the common liquid chamber $S_R$.

An opening portion 482A is formed in the pressure chamber substrate 482 for each of the nozzles N. The vibration plate 483 is a flat plate member which is elastically deformable and provided on the surface of the pressure chamber substrate 482 that is opposite to the flow path substrate 481. The space that is interposed between the vibration plate 483 and the flow path substrate 481 at the inside of the opening portion 482A of the pressure chamber substrate 482 functions as a pressure chamber $S_C$ (cavity) in which the ink supplied through the branch flow path 481B from the common liquid chamber $S_R$ is filled. Each pressure chamber $S_C$ communicates with the nozzles N through the communication flow path 481C of the flow path substrate 481.

The piezoelectric element 484 is formed on the surface of the vibration plate 483 that is opposite to the pressure chamber substrate 482 for each of the nozzles N. Each piezoelectric element 484 is a driving element in which a piezoelectric body is interposed between electrodes that are opposite to each other. When the piezoelectric element 484 is deformed by the supply of the driving signal and thus the vibration plate 483 is vibrated, the pressure in the pressure chamber $S_C$ varies, and thus the ink in the pressure chamber $S_C$ is ejected from the nozzles N. The sealing body 486 protects each piezoelectric element 484.

Figure 15:
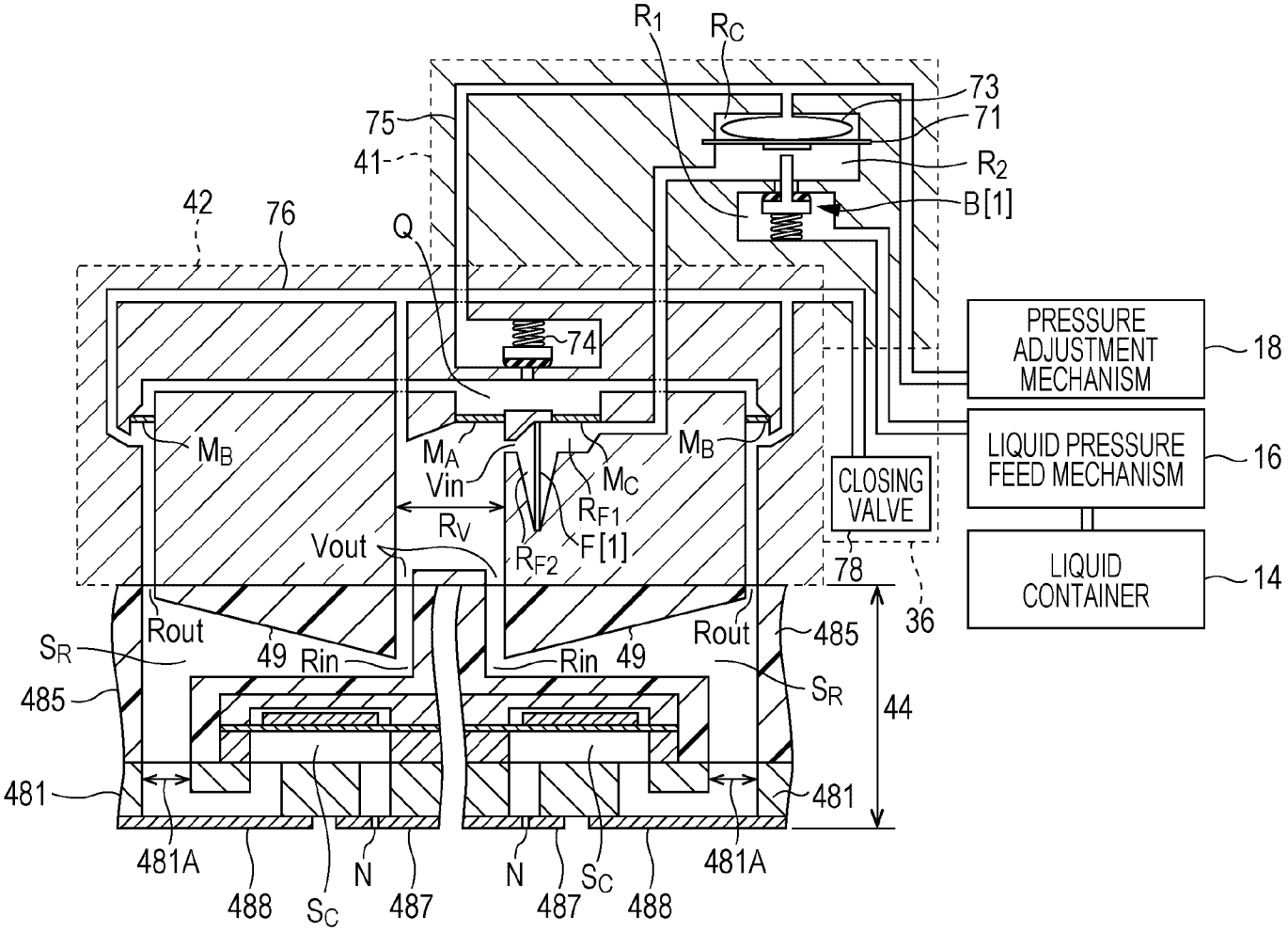
FIG. 15 is an explanatory diagram illustrating the internal flow path of the liquid ejecting unit.

FIG. 15 is an explanatory diagram of the internal flow path of the liquid ejecting unit 40. In FIG. 15, for convenience, although the flow path for supplying the ink to the first ejecting portions $D_A$ of the driving portion D[1] and the driving portion D[2] through the opening/closing valve B[1] and the filter F[1] is illustrated, the same configuration is provided for the other flow paths that are described with reference to FIG. 13. The valve mechanism unit 41, the flow path unit 42, and the housing portion 485 of the liquid ejecting portion 44 function as a flow path structure that constitutes the internal flow path for supplying the ink to the nozzles N.

Figure 16:
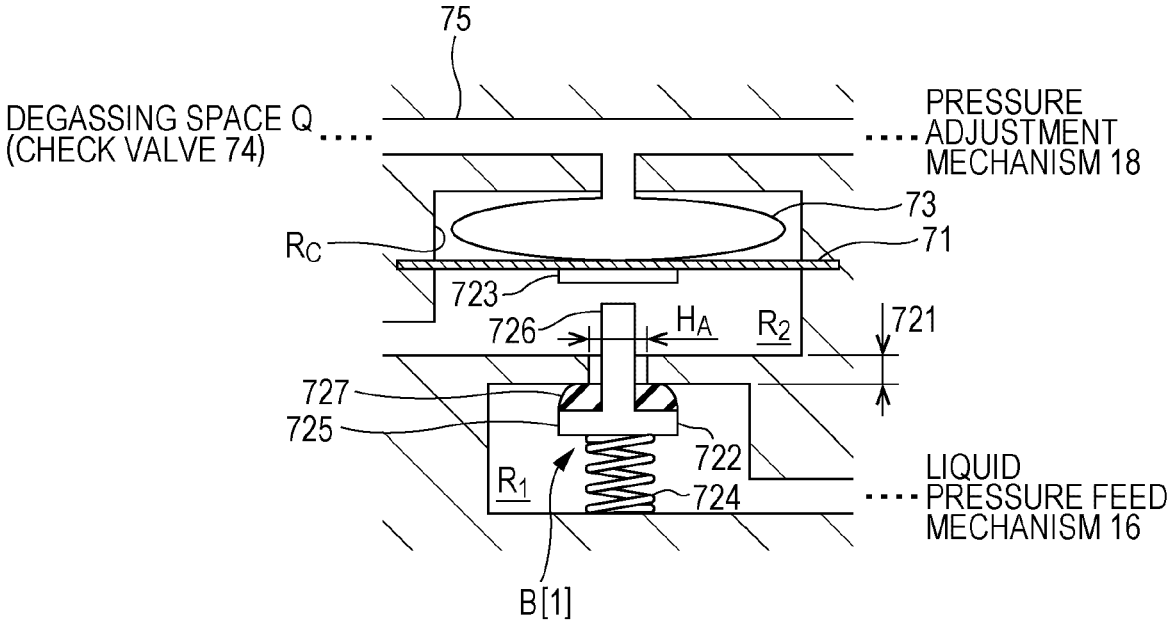
FIG. 16 is a configuration diagram of an opening/closing valve of a valve mechanism unit.

FIG. 16 is an explanatory diagram focusing on the inside of the valve mechanism unit 41. As illustrated in FIGS. 15 and 16, a space $R_1$, a space $R_2$, and a control chamber $R_C$ are formed in the inside of the valve mechanism unit 41. The space $R_1$ is connected to a liquid pressure feed mechanism 16 through the distribution flow path 36. The liquid pressure feed mechanism 16 is a mechanism that supplies (that is, pressure-feeds) the ink stored in the liquid container 14 to the liquid ejecting unit 40 in a pressurized state. The opening/closing valve B[1] is provided between the space $R_1$ and the space $R_2$, and a movable film 71 is interposed between the space $R_2$ and the control chamber $R_C$. As illustrated in FIG. 16, the opening/closing valve B[1] includes a valve seat 721, a valve body 722, a pressure receiving plate 723, and a spring 724. The valve seat 721 is a flat plate-shaped portion that partitions the space $R_1$ and the space $R_2$. In the valve seat 721, a communication hole HA that allows the space $R_1$ to communicate with the space $R_2$ is formed. The pressure receiving plate 723 is a substantially circular-shaped flat plate member which is provided on the surface of the movable film 71 that faces the valve seat 721.

The valve body 722 according to the first embodiment includes a base portion 725, a valve shaft 726, and a sealing portion (seal) 727. The valve shaft 726 projects vertically from the surface of the base portion 725, and the ring-shaped sealing portion 727 that surrounds the valve shaft 726 in a plan view is provided on the surface of the base portion 725. The valve body 722 is disposed within the space $R_1$ in the state where the valve shaft 726 is inserted into the communication hole HA, and biased to the valve seat 721 side by the spring 724. A gap is formed between the outer peripheral surface of the valve shaft 726 and the inner peripheral surface of the communication hole $H_A$.

As illustrated in FIG. 16, a bag-shaped body 73 is provided in the control chamber $R_C$. The bag-shaped body 73 is a bag-shaped member that is formed with an elastic material such as rubber or the like, expands by pressurization in the internal space, and contracts by depressurization in the internal space. As illustrated in FIG. 15, the bag-shaped body 73 is connected to a pressure adjustment mechanism 18 via the flow path in the distribution flow path 36. The pressure adjustment mechanism 18 can selectively execute a pressurization operation for supplying air to the flow path that is connected to the pressure adjustment mechanism 18, and a depressurization operation for sucking air from the flow path, according to an instruction from the control unit 20. The bag-shaped body 73 expands by supplying air from the pressure adjustment mechanism 18 to the internal space (that is, pressurizing), and the bag-shaped body 73 contracts by sucking air using the pressure adjustment mechanism 18 (that is, depressurizing).

In the state where the bag-shaped body 73 is contracted, in a case where the pressure in the space $R_2$ is maintained within a predetermined range, the valve body 722 is biased by the spring 724, and thus the sealing portion 727 is brought to close contact with the surface of the valve seat 721. Therefore, the space $R_1$ and the space $R_2$ are separated from each other. On the other hand, when the pressure in the space $R_2$ is lowered to a value less than a predetermined threshold value due to the ejection of the ink by the liquid ejecting portion 44 or the suction of the ink from the outside, the movable film 71 is displaced to the valve seat 721 side, and thus the pressure receiving plate 723 pressurize the valve shaft 726. As a result, the valve body 722 is moved against biasing by the spring 724, and thus the sealing portion 727 is separated from the valve seat 721. Therefore, the space $R_1$ and the space $R_2$ communicate with each other via the communication hole $H_A$.

When the bag-shaped body 73 expands due to the pressurization by the pressure adjustment mechanism 18, the movable film 71 is displaced to the valve seat 721 side due to the pressurization by the bag-shaped body 73. Therefore, the valve body 722 is moved due to the pressurization by the pressure receiving plate 723, and thus the opening/closing valve B[1] is opened. In other words, regardless of the level of the pressure in the space $R_2$, it is possible to forcibly open the opening/closing valve B[1] by the pressurization by the pressure adjustment mechanism 18.

As illustrated in FIG. 15, the flow path unit 42 according to the first embodiment includes a degassing space Q, a filter F[1], a vertical space $R_V$, and a check valve 74. The degassing space Q is a space in which the air bubble extracted from the ink temporarily stays.

The filter F[1] is provided so as to cross the internal flow path for supplying the ink to the liquid ejecting portion 44, and collects air bubbles or foreign matters mixed into the ink. Specifically, the filter F[1] is provided so as to partition the space $R_{F1}$ and the space $R_{F2}$. The space $R_{F1}$ at the upstream side communicates with the space $R_2$ of the valve mechanism unit 41, and the space $R_{F2}$ at the downstream side communicates with the vertical space $R_V$.

A gas-permeable film $M_C$ (an example of a second gas-permeable film) is interposed between the space $R_{F1}$ and the degassing space Q. Specifically, the ceiling surface of the space $R_{F1}$ is configured with the gas-permeable film $M_C$. The gas-permeable film $M_C$ is a gas-permeable film body that transmits gas (air) and does not transmit liquid such as ink or the like (gas-liquid separation film), and is formed with, for example, a known polymer material. The air bubble collected by the filter F[1] reaches the ceiling surface of the space $R_{F1}$ due to the rise by buoyancy, passes through the gas-permeable film $M_C$, and is discharged to the degassing space Q. In other words, the air bubble mixed into the ink is separated.

The vertical space $R_V$ is a space for temporarily storing the ink. In the vertical space $R_V$ according to the first embodiment, an inflow port $V_{in}$ into which the ink passed through the filter F[1] flows from the space $R_{F2}$, and outflow ports $V_{out}$ through which the ink flows out to the nozzles N side are formed. In other words, the ink in the space $R_{F2}$ flows into the vertical space $R_V$ via the inflow port $V_{in}$, and the ink in the vertical space $R_V$ flows into the liquid ejecting portion 44 (common liquid chamber $S_R$) via the outflow ports $V_{out}$. As illustrated in FIG. 15, the inflow port $V_{in}$ is positioned at the position higher than the outflow ports $V_{out}$ in the vertical direction (negative Z-direction).

A gas-permeable film MA (an example of a first gas-permeable film) is interposed between the vertical space $R_V$ and the degassing space Q. Specifically, the ceiling surface of the vertical space $R_V$ is configured with the gas-permeable film MA. The gas-permeable film $M_A$ is a gas-permeable film body that is similar to the gas-permeable film $M_C$ described above. Accordingly, the air bubble that passed through the filter F[1] and entered into the vertical space $R_V$ rises by the buoyancy, passes through the gas-permeable film MA of the ceiling surface of the vertical space $R_V$, and is discharged to the degassing space Q. As described above, the inflow port $V_{in}$ is positioned at the position at the position higher than the outflow ports $V_{out}$ in the vertical direction, and thus the air bubble can effectively reach the gas-permeable film MA of the ceiling surface using the buoyancy in the vertical space $R_V$.

In the common liquid chamber $S_R$ of the liquid ejecting portion 44, as described above, the inflow port $R_{in}$ into which the ink supplied from the outflow port $V_{out}$ of the vertical space $R_V$ flows is formed. In other words, the ink that flowed out from the outflow port $V_{out}$ of the vertical space $R_V$ flows into the common liquid chamber $S_R$ via the inflow port $R_{in}$, and is supplied to each pressure chamber $S_C$ through the opening portion 481A. In the common liquid chamber $S_R$ according to the first embodiment, a discharge port $R_{out}$ is formed. The discharge port $R_{out}$ is a flow path that is formed on the ceiling surface 49 of the common liquid chamber $S_R$. As illustrated in FIG. 15, the ceiling surface 49 of the common liquid chamber $S_R$ is an inclined surface (flat surface or curved surface) which rises from the inflow port $R_{in}$ side to the discharge port $R_{out}$ side. Therefore, the air bubble that is entered from the inflow port $R_{in}$ is guided to the discharge port $R_{out}$ side along the ceiling surface 49 by the action of the buoyancy.

A gas-permeable film MB (an example of a first gas-permeable film) is interposed between the common liquid chamber $S_R$ and the degassing space Q. The gas-permeable film $M_B$ is a gas-permeable film body that is similar to the gas-permeable film $M_A$ or the gas-permeable film $M_C$. Therefore, the air bubble that is entered from the common liquid chamber $S_R$ to the discharge port $R_{out}$ rises by the buoyancy, passes through the gas-permeable film MB, and is discharged to the degassing space Q. As described above, the air bubble in the common liquid chamber $S_R$ is guided to the discharge port $R_{out}$ along the ceiling surface 49, and thus it is possible to effectively discharge the air bubble in the common liquid chamber $S_R$, compared to a configuration in which, for example, the ceiling surface 49 of the common liquid chamber $S_R$ is a horizontal plane. The gas-permeable film $M_A$, the gas-permeable film MB, and the gas-permeable film $M_C$ may be formed with a single film body.

As described above, in the first embodiment, the gas-permeable film $M_A$ is interposed between the vertical space $R_V$ and the degassing space Q, the gas-permeable film MB is interposed between the common liquid chamber $S_R$ and the degassing space Q, and the gas-permeable film $M_C$ is interposed between the space $R_{F1}$ and the degassing space Q. In other words, the air bubbles that passed through each of the gas-permeable film $M_A$, the gas-permeable film $M_B$, and the gas-permeable film $M_C$ reach the common degassing space Q. Therefore, there is an advantage in that the structure for discharging the air bubbles is simplified, compared to a configuration in which the air bubbles extracted in each unit of the liquid ejecting unit 40 are supplied to each individual space.

As illustrated in FIG. 15, the degassing space Q communicates with a degassing path 75. The degassing path 75 is a path for discharging the air stayed in the degassing space Q to the outside of the apparatus. The check valve 74 is interposed between the degassing space Q and the degassing path 75. The check valve 74 is a valve mechanism that allows the circulation of air directed to the degassing path 75 from the degassing space Q, on the one hand, and inhibits the circulation of air directed to the degassing space Q from the degassing path 75.

Figure 17:
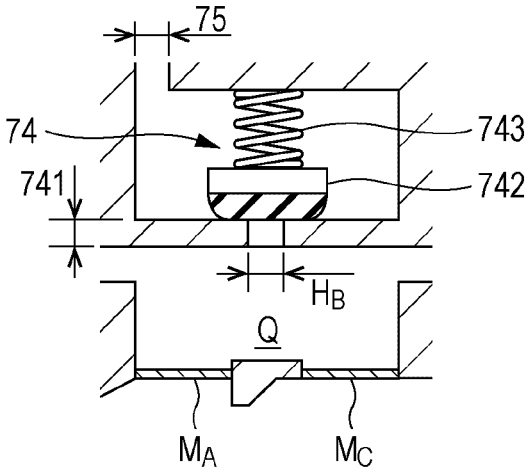
FIG. 17 is an explanatory diagram illustrating a degassing space and a check valve.

FIG. 17 is an explanatory diagram focusing on the vicinity of the check valve 74 of the flow path unit 42. As illustrated in FIG. 17, the check valve 74 according to the first embodiment includes a valve seat 741, a valve body 742, and a spring 743. The valve seat 741 is a flat plate-shaped portion that partitions the degassing space Q and the degassing path 75. In the valve seat 741, a communication hole HB that allows the degassing space Q to communicate with the degassing path 75 is formed. The valve body 742 is opposite to the valve seat 741, and biased to the valve seat 741 side by the spring 743. In a state where the pressure in the degassing path 75 is maintained to the pressure equal to or greater than the pressure in the degassing space Q (state where the inside of the degassing path 75 is opened to the atmosphere or pressurized), the valve body 742 is brought to close contact with the valve seat 741 by biasing of the spring 743, and thus the communication hole HB is closed. Therefore, the degassing space Q and the degassing path 75 are separated from each other. On the other hand, in a state where the pressure in the degassing path 75 is less than the pressure in the degassing space Q (state where the inside of the degassing path 75 is depressurized), the valve body 742 is separated from the valve seat 741 against biasing by the spring 743. Therefore, the degassing space Q and the degassing path 75 communicate with each other via the communication hole HB.

The degassing path 75 according to the first embodiment is connected to the path for coupling the pressure adjustment mechanism 18 and the control chamber $R_C$ of the valve mechanism unit 41. In other words, the path connected to the pressure adjustment mechanism 18 is branched into two systems, and one of the two systems is connected to the control chamber $R_C$ and the other of the two systems is connected to the degassing path 75.

As illustrated in FIG. 15, a discharge path 76 that starts from the liquid ejecting unit 40 and reaches the inside of the distribution flow path 36 via the valve mechanism unit 41 is formed. The discharge path 76 is a path that communicates with the internal flow path of the liquid ejecting unit 40 (specifically, the flow path for supplying the ink to the liquid ejecting portion 44). Specifically, the discharge path 76 communicates with the discharge port $R_{out}$ of the common liquid chamber $S_R$ of each liquid ejecting portion 44 and the vertical space $R_V$.

The end of the discharge path 76 that is opposite to the liquid ejecting unit 40 is connected to a closing valve 78. The position at which the closing valve 78 is provided is arbitrary, but the configuration in which the closing valve 78 is provided in the distribution flow path 36 is illustrated in FIG. 15. The closing valve 78 is a valve mechanism that can close the discharge path 76 in a normal state (normally close) and temporarily open the discharge path 76 to the atmosphere.

Figure 18:
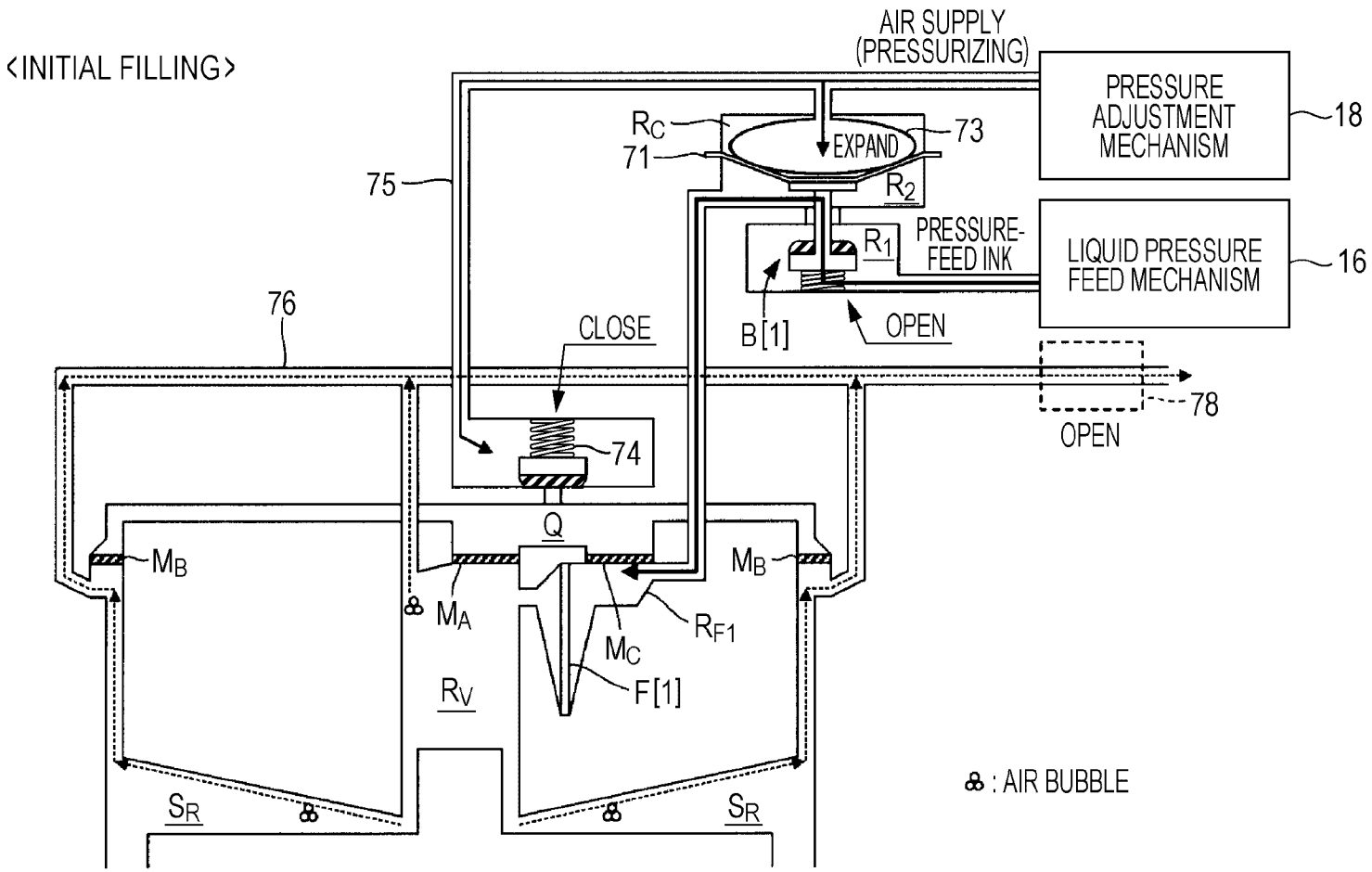
FIG. 18 is an explanatory diagram illustrating a state of the liquid ejecting head at the time of initial filling.

The operation of the liquid ejecting unit 40 will be described focusing on the discharge of the air bubble from the internal flow path. As illustrated in FIG. 18, in the stage of initially filling the liquid ejecting unit 40 with the ink (hereinafter, referred to as "initial filling"), the pressure adjustment mechanism 18 executes the pressurization operation. In other words, the internal space of the bag-shaped body 73 and the inside of the degassing path 75 are pressurized by the supply of air. Therefore, the bag-shaped body 73 in the control chamber $R_C$ expands, and thus the movable film 71 and the pressure receiving plate 723 are displaced. As a result, the valve body 722 is moved due to the pressurization by the pressure receiving plate 723, and thus the space $R_1$ and the space $R_2$ communicate with each other.

In a state where the degassing path 75 is pressurized, the degassing space Q and the degassing path 75 are separated from each other by the check valve 74, and thus the air in the degassing path 75 does not flow into the degassing space Q. On the other hand, in the initial filling stage, the closing valve 78 is opened.

In the above state, the liquid pressure feed mechanism 16 pressure-feeds the ink stored in the liquid container 14 to the internal flow path of the liquid ejecting unit 40. Specifically, the ink that is pressure-fed from the liquid pressure feed mechanism 16 is supplied to the vertical space $R_V$ via the opening/closing valve B[1] in the open state, and supplied from the vertical space $R_V$ to the common liquid chamber $S_R$ and each pressure chamber $S_C$. As described above, since the closing valve 78 is opened, the air that is present in the internal flow path before the execution of the initial filling passes through the discharge path 76 and the closing valve 78, and is discharged to the outside of the apparatus, at the same timing of filling the internal flow path and the discharge path 76 with the ink. Therefore, the entire internal flow path including the common liquid chamber $S_R$ and each pressure chamber $S_C$ of the liquid ejecting unit 40 is filled with the ink, and thus the nozzles N can eject the ink by the operation of the piezoelectric element 484. As described above, in the first embodiment, the closing valve 78 is opened when the ink is pressure-fed from the liquid pressure feed mechanism 16 to the liquid ejecting unit 40, and thus it is possible to efficiently fill the internal flow path of the liquid ejecting unit 40 with the ink. When the initial filling described above is completed, the pressurization operation by the pressure adjustment mechanism 18 is stopped, and the closing valve 78 is closed.

Figure 19:
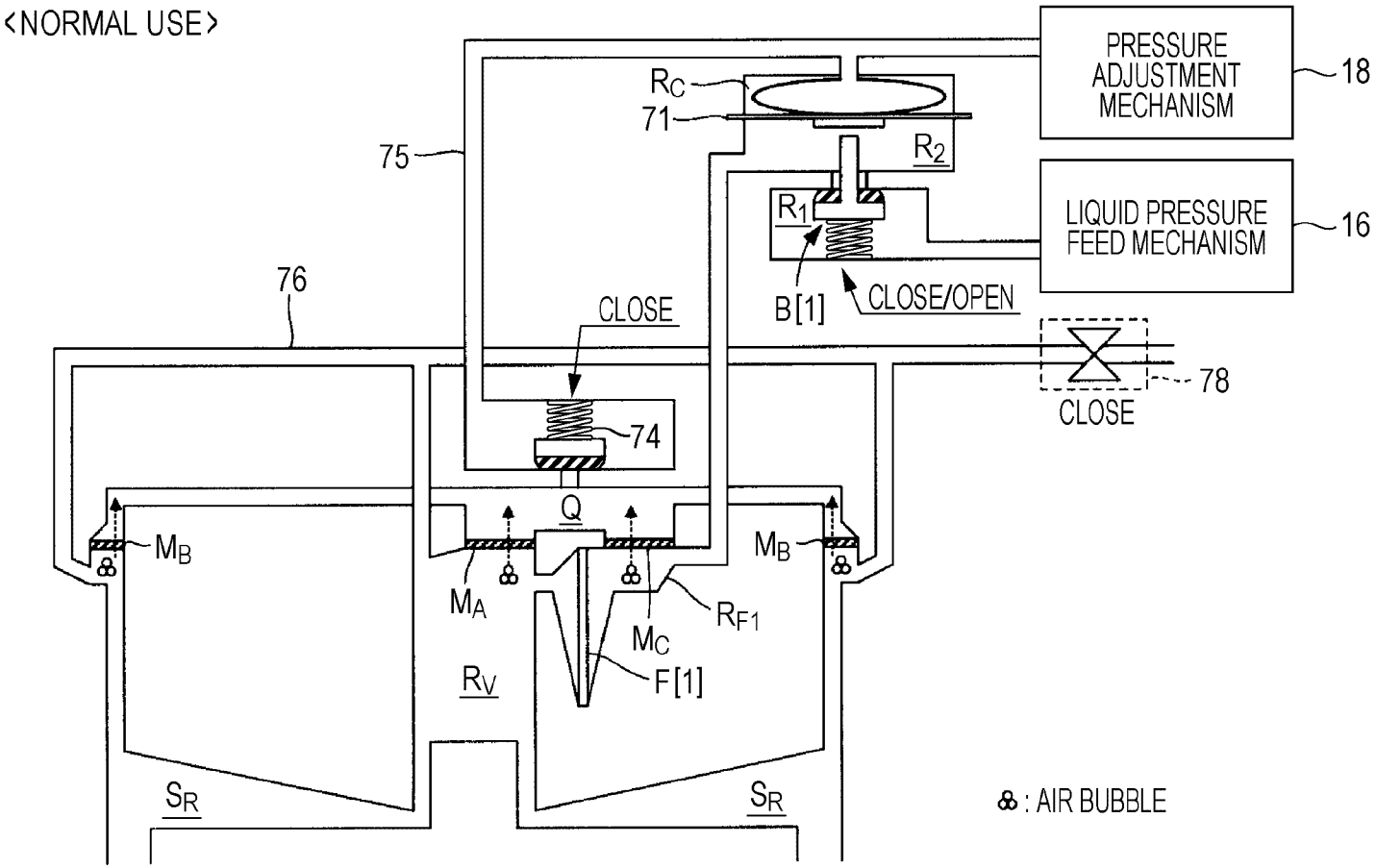
FIG. 19 is an explanatory diagram illustrating a state of the liquid ejecting head at the time of normal use.

As illustrated in FIG. 19, in a state where the initial filling is completed and thus the liquid ejecting apparatus 100 can be used, the air bubble that is present in the internal flow path of the liquid ejecting unit 40 is discharged at all times to the degassing space Q. More specifically, the air bubble in the space $R_{F1}$ is discharged to the degassing space Q via the gas-permeable film $M_C$, the air bubble in the vertical space $R_V$ is discharged to the degassing space Q via the gas-permeable film $M_A$, and the air bubble in the common liquid chamber $S_R$ is discharged to the degassing space Q via the gas-permeable film $M_B$. On the other hand, the opening/closing valve B[1] is closed in a state where the pressure in the space $R_2$ is maintained within a predetermined range, and opened in a state where the pressure in the space $R_2$ is less than a predetermined threshold value. When the opening/closing valve B[1] is opened, the ink supplied from the liquid pressure feed mechanism 16 flows from the space $R_1$ to the space $R_2$, and as a result, the pressure of the space $R_2$ increases. Thus, the opening/closing valve B[1] is closed.

Figure 20:
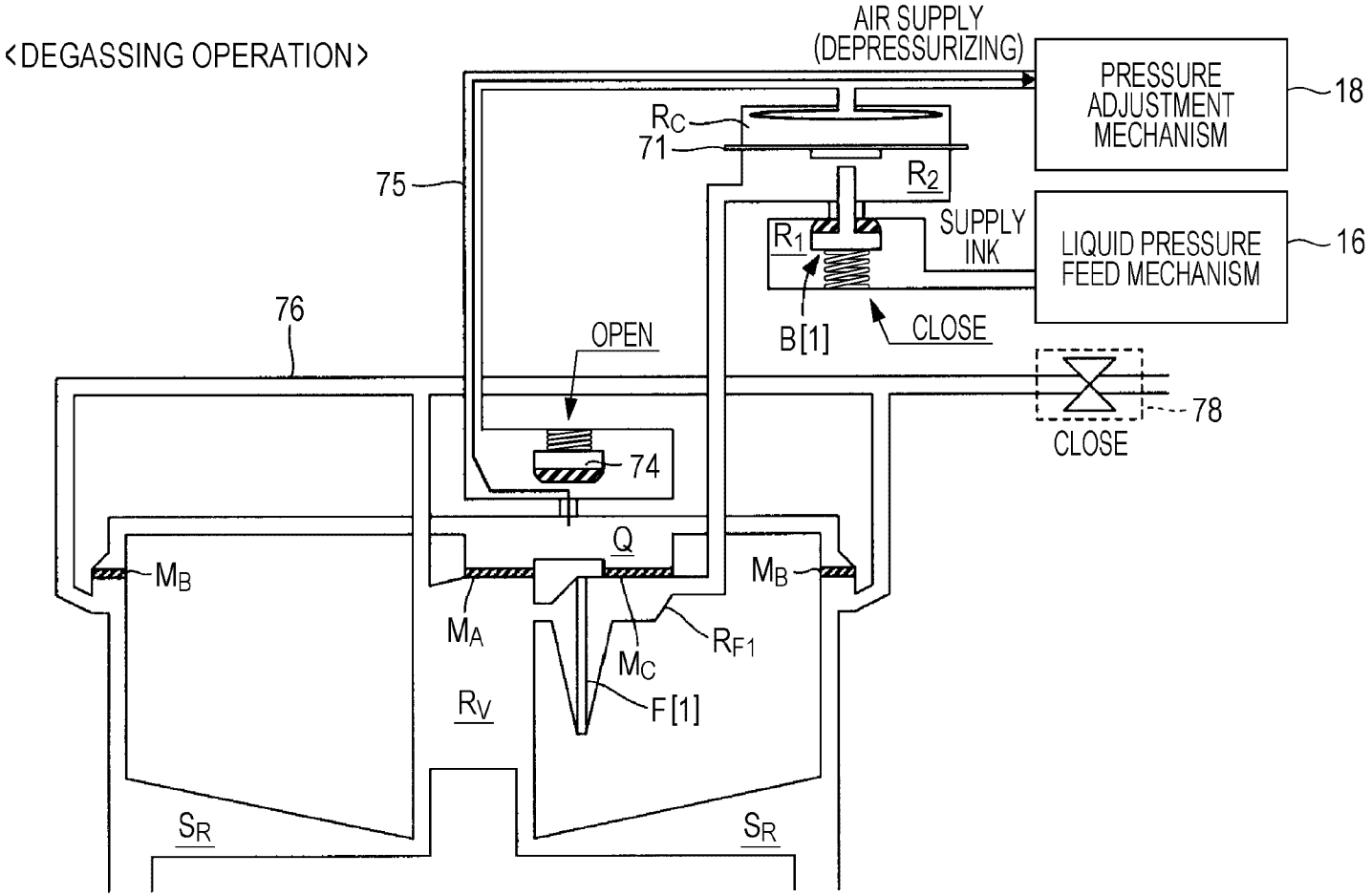
FIG. 20 is an explanatory diagram illustrating a state of the liquid ejecting head at the time of a degassing operation.

In the operating state illustrated in FIG. 19, the air stayed in the degassing space Q is discharged to the outside of the apparatus by the degassing operation. The degassing operation may be executed at any period of time, for example, such as immediately after the power-on of the liquid ejecting apparatus 100, during a period of the printing operation, or the like. FIG. 20 is an explanatory diagram of a degassing operation. As illustrated in FIG. 20, when the degassing operation is started, the pressure adjustment mechanism 18 executes the depressurization operation. In other words, the internal space and the degassing path 75 of the bag-shaped body 73 are depressurized by the suction of air.

When the degassing path 75 is depressurized, the valve body 742 of the check valve 74 is separated from the valve seat 741 against biasing by the spring 743, and the degassing space Q and the degassing path 75 communicate with each other via the communication hole HB. Therefore, the air in the degassing space Q is discharged to the outside of the apparatus via the degassing path 75. On the other hand, although the bag-shaped body 73 contracts by depressurization in the internal space, there is no influence on the pressure in the control chamber $R_C$ (further the movable film 71), and thus the opening/closing valve B[1] is maintained in a state of being closed.

As described above, in the first embodiment, the pressure adjustment mechanism 18 is commonly used in the opening/closing of the opening/closing valve B[1] and the opening/closing of the check valve 74, and thus there is an advantage in that the configuration for controlling the opening/closing valve B[1] and the check valve 74 is simplified, compared to a configuration in which the opening/closing valve B[1] and the check valve 74 are controlled by each individual mechanism.

Figure 21:
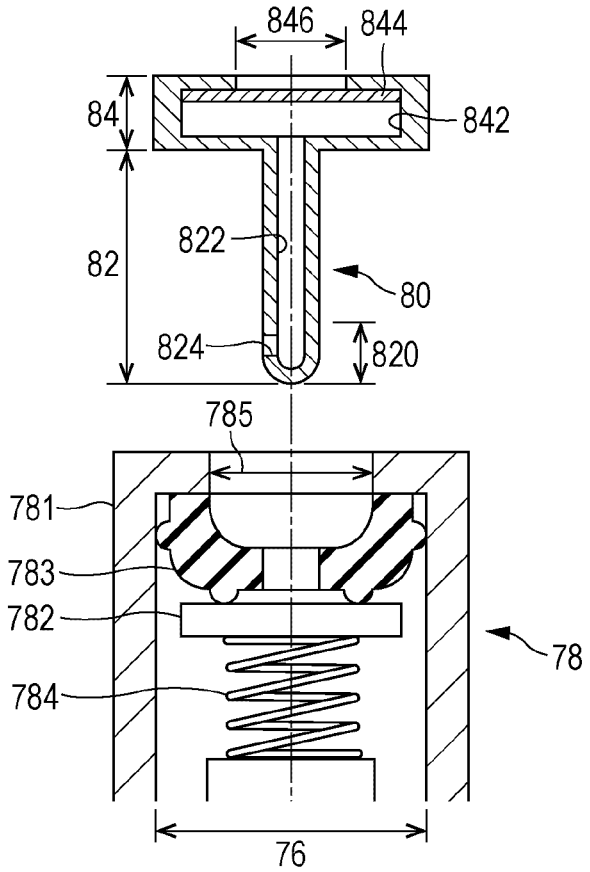
FIG. 21 is a sectional view of a closing valve and an opening valve unit.

The specific configuration of the closing valve 78 in the first embodiment will be described. FIG. 21 is a sectional view illustrating the configuration of the closing valve 78. As illustrated in FIG. 21, the closing valve 78 according to the first embodiment includes a communication tube 781, a moving object 782, a sealing portion 783, and a spring 784. The communication tube 781 is a circular tube body in which an opening portion 785 is formed on the end surface, and accommodates the moving object 782, the sealing portion 783, and the spring 784. The internal space of the communication tube 781 corresponds to the end portion of the discharge path 76.

The sealing portion 783 is a ring-shaped member that is formed with an elastic material such as rubber or the like, and is provided at one end side of the internal space of the communication tube 781 so as to be concentrical with the communication tube 781. The moving object 782 is a member that is movable in the direction of the center axis of the communication tube 781 in the inside of the communication tube 781. As illustrated in FIG. 21, the moving object 782 is brought to close contact with the sealing portion 783 by biasing of the spring 784. The moving object 782 and the sealing portion 783 are brought to close contact with each other, and thus the discharge path 76 inside the communication tube 781 is closed. As described above, since the moving object 782 is biased so as to close the discharge path 76, when normal use of the liquid ejecting apparatus 100 (FIG. 19), it is possible to reduce the possibility that the air bubble is mixed into the ink in the liquid ejecting unit 40 via the discharge path 76, or the possibility that the ink in the liquid ejecting unit 40 is leaked via the discharge path 76. On the other hand, when the moving object 782 is separated from the sealing portion 783 by the action of external force via the opening portion 785 of the communication tube 781, the discharge path 76 inside the communication tube 781 communicates with the outside via the sealing portion 783. In other words, the discharge path 76 is in an opened state (FIG. 18).

In the stage of the initial filling illustrated in FIG. 18, in order to move the moving object 782 of the closing valve 78, a valve opening unit 80 of FIG. 21 is used. The valve opening unit 80 according to the first embodiment includes an insertion portion 82 and a base portion 84. The insertion portion 82 is a needle-shaped portion in which a communication flow path 822 is formed, and an opening portion 824 that communicates with the communication flow path 822 is formed at the tip portion 820 of the insertion portion 82 (opposite side of the base portion 84). The base portion 84 includes a storage space 842 that communicates with the communication flow path 822 of the insertion portion 82, a gas-permeable film 844 that closes the communication flow path 822, and a discharge port 846 that is formed on the opposite side of the communication flow path 822 interposing the gas-permeable film 844.

Figure 22:
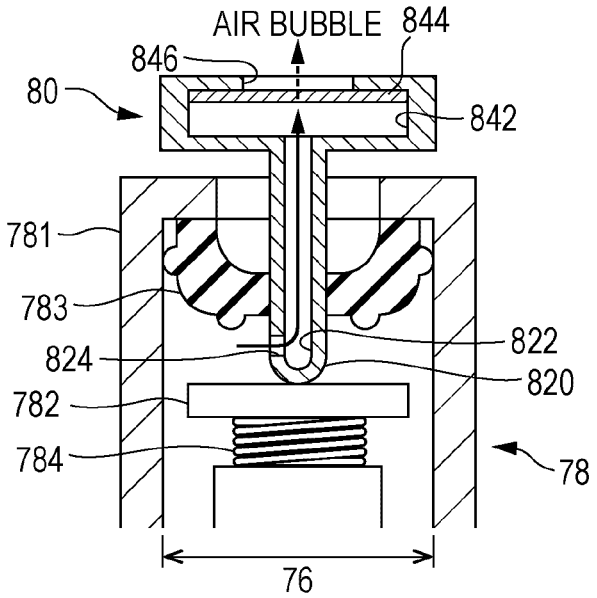
FIG. 22 is an explanatory view illustrating a state where the closing valve is opened using the opening valve unit.

In the stage of the initial filling, as illustrated in FIG. 22, the insertion portion 82 of the valve opening unit 80 is inserted from the opening portion 785 to the communication tube 781. The moving object 782 is moved in a direction away from the sealing portion 783 by the external force applied from the tip portion 820 of the insertion portion 82. When the insertion portion 82 is further inserted, the outer peripheral surface of the insertion portion 82 and the inner peripheral surface of the sealing portion 783 are brought close contact with each other, and thus the insertion portion 82 is in a state of being held by the sealing portion 783. In the above state, the opening portion 824 of the insertion portion 82 is positioned at the discharge path 76 side (moving object 782 side) when viewed from the sealing portion 783. In other words, the portion between the outer peripheral surface of the insertion portion 82 that is at the base portion side when viewed from the opening portion 824 and the inner peripheral surface of the communication tube 781 (inner peripheral surface of the discharge path 76) is sealed by the sealing portion 783. The position of the moving object 782 in the above state is hereinafter referred to as the "opened position". In a state where the moving object 782 is moved to the opened position, the discharge path 76 communicates with the storage space 842 via the opening portion 824 of the tip portion 820 of the valve opening unit 80. As can be understood from the above description, in the first embodiment, it is possible to easily move the moving object 782 to the opened position by the insertion of the valve opening unit 80.

As described above with reference to FIG. 18, when the ink is pressure-fed from the liquid pressure feed mechanism 16, the moving object 782 is moved to the opened position by inserting the valve opening unit 80 into the opening portion 785 of the communication tube 781. Therefore, the air that is present in the internal flow path of the liquid ejecting unit 40 is discharged to the discharge path 76 together with the ink, as illustrated by the arrow in FIG. 22, passes through the opening portion 824 and the communication flow path 822, and reaches the storage space 842 of the valve opening unit 80. The air bubble that reached the storage space 842 passes through the gas-permeable film 844, and is discharged from the discharge port 846 to the outside. As described above, in the first embodiment, the gas-permeable film 844 that closes the communication flow path 822 of the valve opening unit 80 is provided, and thus it is possible to reduce the possibility that the liquid which flows into the communication flow path 822 from the discharge path 76 leaks from the valve opening unit 80.

In the first embodiment, the portion between the outer peripheral surface of the valve opening unit 80 and the inner peripheral surface of the discharge path 76 (the inner peripheral surface of the communication tube 781) is sealed by the sealing portion 783, and thus it is possible to reduce the possibility that the ink leaks via the gap between the outer peripheral surface of the valve opening unit 80 and the inner peripheral surface of the discharge path 76. In addition, in the first embodiment, the sealing portion 783 is commonly used in the sealing between the outer peripheral surface of the valve opening unit 80 and the inner peripheral surface of the discharge path 76, and in the sealing between the moving object 782 and the inner peripheral surface of the discharge path 76. Therefore, there is an advantage in that the structure of the closing valve 78 is simplified, compared to a configuration in which each individual member is used in both sealing.

Second Embodiment

A second embodiment according to the invention will be described. In each configuration to be described below, elements having the same operation or function as that of the first embodiment are denoted by the same reference numerals used in the description of the first embodiment, and the detailed description thereof will not be appropriately repeated.

Figure 23:
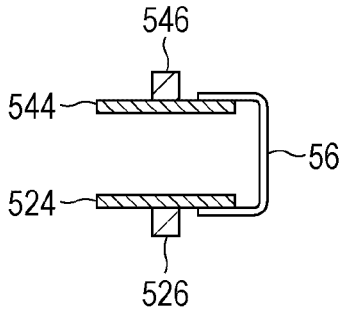
FIG. 23 is an explanatory diagram illustrating the arrangement of a transmission line according to a second embodiment.

FIG. 23 is an explanatory diagram of the arrangement of the transmission line 56 in the second embodiment. In the first embodiment, as described above with reference to FIG. 6, the configuration in which one end of the transmission line 56 is bonded to the surface of the wiring substrate 544 that is opposite to the connection portion 546 and the other end of the transmission line 56 is bonded to the surface of the wiring substrate 524 that is opposite to the connection portion 526 is illustrated. In the second embodiment, as illustrated in FIG. 23, one end of the transmission line 56 is bonded to the surface of the wiring substrate 544 on which the connection portion 546 is provided, and the other end of the transmission line 56 is bonded to the surface of the wiring substrate 524 on which the connection portion 526 is provided. In other words, the transmission line 56 is bent so as to reach the surface of the wiring substrate 524 in the positive Z-direction side from the surface of the wiring substrate 544 in the negative Z-direction side.

As in the first embodiment, in the configuration in which the transmission line 56 is bonded to the surface that is opposite to the connection portion 546 and the surface that is opposite to the connection portion 526, there is a need to form a conduction hole (via hole) for electrically connecting the connection portion 546 and the transmission line 56 on the wiring substrate 544, and form a conduction hole for electrically connecting the connection portion 526 and the transmission line 56 on the wiring substrate 524. In the second embodiment, one end of the transmission line 56 is bonded to the surface of the wiring substrate 544 that is at the connection portion 546 side, and the other end of the transmission line 56 is bonded to the surface of the wiring substrate 524 that is at the connection portion 526 side. Thus, there is an advantage in that there is no need to form the conduction holes on the surface of the wiring substrate 544 and on the surface of the wiring substrate 524.

Third Embodiment

Figure 24:
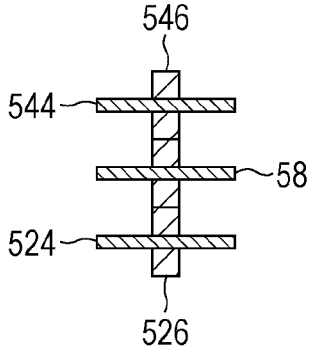
FIG. 24 is a configuration diagram of a coupling unit according to a third embodiment.

FIG. 24 is a partial block diagram of the coupling unit 50 in a third embodiment. In the first embodiment, the connection portion 546 and the liquid ejecting unit 40 are electrically connected to each other by the flexible transmission line 56. In the third embodiment, as illustrated in FIG. 24, the connection portion 546 of the wiring substrate 544 and the connection portion 384 of the liquid ejecting unit 40 are electrically connected to each other by a connection portion 58. The connection portion 58 is a connector (board-to-board connector) having a floating structure, and can absorb the tolerance by the configuration capable of movement to the connection target. Therefore, even in the third embodiment, as in the first embodiment, it is possible to easily assemble or disassemble the liquid ejecting head 24 without considering the stress that is applied from the connection portion 546 to the liquid ejecting unit 40 (further the position deviation of the liquid ejecting unit 40).

As can be understood from the above description, the transmission line 56 in the first embodiment and the second embodiment and the connection portion 58 in the third embodiment are generically expressed as the connector body that is provided between the connection portion 546 and the liquid ejecting unit 40 so as to absorb the error in the position between the connection portion 546 and the liquid ejecting unit 40, and that couples the connection portion 546 and the liquid ejecting unit 40.

Fourth Embodiment

Figure 25:
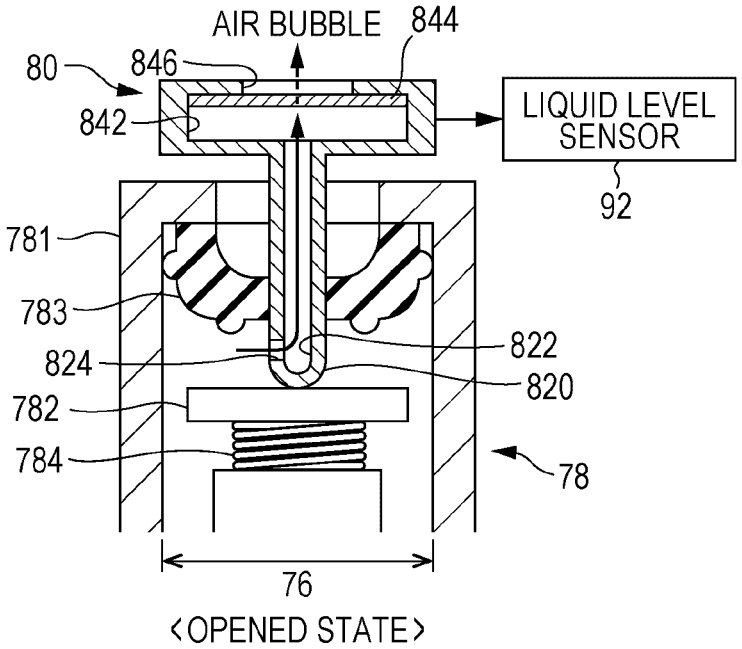
FIG. 25 is a sectional view of an opening/closing valve and an opening valve unit according to a fourth embodiment.

FIG. 25 is a configuration diagram of the closing valve 78 and the valve opening unit 80 in a fourth embodiment. As illustrated in FIG. 25, a liquid level sensor 92 is connected to the valve opening unit 80 according to the fourth embodiment. The liquid level sensor 92 is a detector that detects the liquid level in the communication flow path 822 of the insertion portion 82 of the valve opening unit 80. For example, an optical sensor that radiates light into the communication flow path 822 and receives the light reflected from the liquid level is suitable as the liquid level sensor 92. In the process of the initial filling illustrated in FIG. 18, as the pressure-feed of the ink to the liquid ejecting unit 40 progresses by the liquid pressure feed mechanism 16, there is a tendency that the liquid level in the communication flow path 822 becomes higher.

In the process of the initial filling, the control unit 20 according to the fourth embodiment controls the pressure-feed by the liquid pressure feed mechanism 16 according to the detection result by the liquid level sensor 92. Specifically, in a case where the liquid level detected by the liquid level sensor 92 is lower than a predetermined reference position, the liquid pressure feed mechanism 16 continues the pressure-feed of the ink to the liquid ejecting unit 40. On the other hand, in a case where the liquid level detected by the liquid level sensor 92 is higher than the reference position, the liquid pressure feed mechanism 16 stops the pressure-feed of the ink to the liquid ejecting unit 40.

In the fourth embodiment, the pressure-feed of the ink by the liquid pressure feed mechanism 16 is controlled according to the detection result of the liquid level in the communication flow path 822 by the liquid level sensor 92, and thus it is possible to suppress excessive supply of the ink to the liquid ejecting unit 40.

Fifth Embodiment

In the fourth embodiment, a configuration that controls the operation of the liquid pressure feed mechanism 16 according to the detection result of the liquid level in the communication flow path 822 is illustrated. In the process of the initial filling illustrated in FIG. 18, the control unit 20 according to the fifth embodiment controls the pressure-feed by the liquid pressure feed mechanism 16 according to the detection result of the ink discharged from the nozzles N of the liquid ejecting unit 40. When the ink is excessively supplied to the liquid ejecting unit 40 from the liquid pressure feed mechanism 16, the ink may leak from the nozzles N of the liquid ejecting unit 40 even in a state where the piezoelectric element 484 is not driven. Thus, the liquid pressure feed mechanism 16 according to the fifth embodiment continues the pressure-feed of the ink to the liquid ejecting unit 40 in a case where the leakage of the ink from a particular nozzle N is not detected, and stops the pressure-feed of the ink in a case where the leakage of the ink from the nozzle N is detected. Although a method of detecting the leakage of the ink is arbitrary, for example, a liquid leakage sensor that detects the ink discharged from the nozzles N may be suitably used. When considering a tendency that the characteristics of the residual vibration in the pressure chamber $S_C$ (the vibration remained in the pressure chamber $S_C$ after the displacement of the piezoelectric element 484) are different according to the presence or absence of the leakage of the ink from the nozzles N, it is also possible to detect the leakage of the ink by analyzing the residual vibration.

In the fifth embodiment, the pressure-feed of the ink by the liquid pressure feed mechanism 16 is controlled according to the detection result of the ink discharged from the nozzles of the liquid ejecting unit 40, and thus it is possible to suppress excessive supply of the ink to the liquid ejecting unit 40.

Modification Example

Each embodiment described above may be variously modified. The specific modification forms will be described below. Two or more forms that are arbitrarily selected from the following examples may be appropriately combined with each other within a range in which the forms are not inconsistent with each other.

(1) It is also possible to discharge the air bubble from the nozzles N by sucking the ink of the internal flow path of the liquid ejecting head 24 from the nozzles N side, in addition to the discharge of the air bubble via the degassing path 75 and the discharge path 76. More specifically, the air bubble is discharged from the nozzles N together with the ink by sealing the ejecting face J with a cap and depressurizing the space between the ejecting face J and the cap. The discharge via the degassing path 75 and the discharge path 76 illustrated in each embodiment described above is effective for the air bubble that is present in the internal flow path of the flow path structure which is configured with the valve mechanism unit 41, the flow path unit 42, and the housing portion 485 of the liquid ejecting portion 44. The discharge by the suction from the nozzles N side is effective for the air bubble that is present in the flow path of the liquid ejecting portion 44 from the branch flow path 481B to the nozzles N.

(2) In each embodiment described above, although the configuration in which the ejecting face J includes the first portion $P_1$, the second portion $P_2$, and the third portion $P_3$ is illustrated, one of the second portion $P_2$ and the third portion $P_3$ may be omitted. In each embodiment described above, although the configuration in which the second portion $P_2$ is positioned at the opposite side of the third portion $P_3$ interposing the center line y is illustrated, the second portion $P_2$ and the third portion $P_3$ may be positioned at the same side with respect to the center line y.

(3) The shape of the beam-shaped portion 62 (or the shape of the opening portion 60) in the first support body 242 is not limited to the shape illustrated in each embodiment described above. For example, in each embodiment described above, although the beam-shaped portion 62 having the shape in which the first support portion 621, the second support portion 622, and the intermediate portion 623 are coupled with each other is illustrated, the beam-shaped portion 62 having the shape in which the intermediate portion 623 is omitted (shape in which the first support portion 621 and the second support portion 622 are separated from each other) may be formed in the first support body 242.

(4) In each embodiment described above, although the serial-type liquid ejecting apparatus 100 in which the transport body 262 equipped with the liquid ejecting head 24 is moved in the X-direction is illustrated, the invention may be applied to the line-type liquid ejecting apparatus in which the plurality of nozzles N of the liquid ejecting head 24 are distributed over the entire width of the medium 12. In the line-type liquid ejecting apparatus, the movement mechanism 26 illustrated in each embodiment described above may be omitted.

(5) The element that applies pressure to the inside of the pressure chamber $S_C$ (driving element) is not limited to the piezoelectric element 484 illustrated in each embodiment described above. For example, a heating element that changes pressure by generating air bubbles to the inside of the pressure chamber $S_C$ by heating may be used as the driving element. As can be understood from the above description, the driving element is generically expressed as the element for ejecting liquid (typically, the element that applies pressure to the inside of the pressure chamber $S_C$), and the operating type (piezoelectric type/heating type) and the specific configuration do not matter.

(6) In each embodiment described above, although the connection portions (328, 384, 526, 546) used for electrical connection are illustrated, the invention may be applied to the connection portion for connecting the flow paths through which liquid such as ink or the like circulates. In other words, the connector body according to the invention includes an element that connects the flow path of the first connection portion and the flow path of the liquid ejecting unit (for example, a tube that is formed with an elastic material), in addition to the element that electrically connects the first connection portion and the liquid ejecting unit (for example, the transmission line 56).

What is claimed is:

1. A liquid ejecting unit that ejects liquid from a plurality of nozzles that are arrayed in an arraying direction, the liquid ejecting unit comprising:

an ejecting face extending in the arraying direction and a crossing direction which is orthogonal to the arraying direction, the plurality of nozzles being formed on the ejecting face in an area, the ejecting face including a first portion that has a first width in the crossing direction, and a second portion that has a second width in the crossing direction, wherein the first portion and the second portion are adjoined with each other in the arraying direction, a first protruding portion, wherein the first protruding portion adjoins an edge of the first portion extending along the crossing direction on the second portion side when viewed from a liquid ejecting direction, wherein the second width is smaller than a half of the first width, wherein a width of an end farthest from the first portion of the first protruding portion is narrower than the width of the second portion in the crossing direction.

2. The liquid ejecting unit according to claim 1, the ejecting face further includes a third portion that has a third width in the crossing direction, wherein the first portion and the third portion are adjoined in the arraying direction with each other and wherein the second portion and the third portion are not adjoined in the arraying direction with each other, wherein the third width is smaller than the half of the first width, wherein the liquid ejecting unit further comprises:

a second protruding portion, wherein the second protruding portion adjoins an edge of the third portion extending along the crossing direction on an opposite side of the first portion when viewed from the liquid ejecting direction.

3. The liquid ejecting unit according to claim 2, wherein the first protruding portion includes a first protruding edge which extends along the arraying direction, wherein the second protruding portion includes a second protruding edge which extends along the arraying direction, wherein the first protruding edge, the second protruding edge, and the edge of the first portion are at a same position in the crossing direction when viewed from the liquid ejecting direction.

4. The liquid ejecting unit according to claim 1, wherein the first protruding portion is offset from the ejecting face in an opposite direction of the liquid ejecting direction.

5. The liquid ejecting unit according to claim 1, wherein the ejecting, face is positioned on a most liquid ejecting direction side of the liquid ejecting unit.

6. The liquid ejecting unit according to claim 1, wherein the first protruding portion is a portion to determine a position of the liquid ejecting unit in the arraying direction and the crossing direction against a support body which supports the liquid ejecting unit.

7. The liquid ejecting unit according to claim 1, wherein a width of an end farthest from the first portion of the first protruding portion is narrower than an end of the first protruding portion adjoining the edge of the first portion in the crossing direction.

8. The liquid ejecting unit according to claim 2, wherein the second protruding portion includes a notch portion, wherein the notch portion has a shape corresponding to the first protruding portion.

* * * * *